US011965690B2

(12) United States Patent
Smith et al.

(10) Patent No.: US 11,965,690 B2
(45) **Date of Patent: *Apr. 23, 2024**

(54) PAN CHILLER WITH IMPROVED HEAT TRANSFER AND TEMPERATURE CONTROL

(71) Applicants: Donald Eugene Smith, Fullerton, CA (US); Christine Marie Smith, Fullerton, CA (US)

(72) Inventors: Donald Eugene Smith, Fullerton, CA (US); Christine Marie Smith, Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/864,961

(22) Filed: Jul. 14, 2022

(65) Prior Publication Data

US 2022/0412642 A1 Dec. 29, 2022

Related U.S. Application Data

(63) Continuation-in-part of application No. 16/989,579, filed on Aug. 10, 2020, now Pat. No. 11,391,494.

(51) Int. Cl.
*F25D 23/06* (2006.01)
*F25D 31/00* (2006.01)

(52) U.S. Cl.
CPC ..... *F25D 23/066* (2013.01); *F25D 23/061* (2013.01); *F25D 31/00* (2013.01)

(58) Field of Classification Search
CPC ..... F25D 23/066; F25D 23/061; F25D 31/00; F25D 31/002; A47F 3/0413
See application file for complete search history.

(56) References Cited

U.S. PATENT DOCUMENTS 5,247,807 A * 9/1993 Jarman ..... A47F 3/0408 62/227
5,248,121 A 9/1993 Harrington
5,381,672 A * 1/1995 Haasis ..... F25D 19/00 62/407
6,000,236 A * 12/1999 Haasis ..... F25D 21/04 D15/66
7,448,224 B2 11/2008 Wu et al.
7,543,455 B1 * 6/2009 Chen ..... F25B 27/005 62/235.1
9,068,773 B2 6/2015 Lintker et al.
9,523,532 B2 12/2016 Delgadillo
9,671,155 B2 6/2017 Delgadillo
(Continued)

*Primary Examiner* — David J Teitelbaum
(74) *Attorney, Agent, or Firm* — Steven A. Nielsen; www.NielsenPatents.com

(57) ABSTRACT

A pan chiller system eschews traditional methods of strapping refrigeration tubing upon an inner liner and obtaining temperature readings from a suction line. The disclosed embodiments overcome shortfalls in the related art by, inter alia, by artfully using a thermal retention assembly that retains refrigeration tubing in the middle of an inner liner. An inner liner may be filled with glycerin or similar products with the glycerin filling a temperature control bulb to obtain accurate temperature readings and avoiding the use of a suction line for such purposes. The disclosed embodiments may also include an air movement system moving cold air at the bottom of the pan and moving air upon the outer sides of the glycerin well and over the top of the well.

1 Claim, 21 Drawing Sheets

(56) References Cited

U.S. PATENT DOCUMENTS

| | | | | |
|---|---|---|---|---|
| 2014/0230468 | A1* | 8/2014 | Delgadillo | F25D 11/00 62/99 |
| 2016/0040941 | A1* | 2/2016 | Luketic | F28F 1/00 29/890.035 |
| 2018/0202685 | A1 | 7/2018 | Pignolo | |

* cited by examiner

PAN CHILLER WITH IMPROVED HEAT TRANSFER AND TEMPERATURE CONTROL

RELATED PATENT APPLICATION AND INCORPORATION BY REFERENCE

This utility patent application is a continuation in part, and is based upon, U.S. patent application Ser. No. 16/989,579 filed on Aug. 10, 2020. This related application is incorporated herein by reference and made a part of this application as if restated herein. If any conflict arises between the disclosure of the invention in this utility application and that in the related application, the disclosure in this utility application shall govern. Moreover, the inventors incorporate herein by reference any and all patents, patent applications, and other documents hard copy or electronic, cited or referred to in this application and/or the related application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to refrigeration systems. More particularly, the invention relates to the manufacture and application of heat transfer and temperature control within a pan chiller.

(2) Description of the Related Art

With respect to the pan chiller aspects of the disclosed embodiments:

U.S. Pat. No. 9,671,155 Cylinder Pan Chiller by Delgadillo issued on Jun. 6, 2017 uses an interesting combination of voids, foam insulation and refrigerant contained or flowing within cylindrical chambers and eschews the movement of air over food products. Unfortunately, the system is limited to a cylindrical format and a constrained fastening system using various rings or lips. The system is not well suited for a traditional pan chiller wherein a plurality of food trays are disposed within a horizontal food chilling system, as each food tray cannot ne efficiently encircled by chilled walls.

U.S. Pat. No. 9,353,986 Glycol Pan Chiller Systems by Delgadillo issued on May 31, 2016 does attempt to use a pool of glycol to transfer heat away from refrigerant lines, with the refrigerant lines circling and in contact with the perimeter and outside surface of an inner pan assembly. Unfortunately, the system lacks any reliable temperature probe pool and requires a plurality of separate cooling systems to remove thermal energy from the various coolant lines and tanks.

U.S. Pat. No. 9,523,532 Glycol Pan Chiller Systems with Integrated Stove Top by Delgadillo issued on Dec. 20, 2016 does use glycol to bathe cooling lines filled with freon, but requires a first and second cooling area, with the second cooling area burdened with a heat exchange system or condenser. Thus, the second cooling area is almost unusable for the cooling of food products.

U.S. Pat. No. 9,068,773 Pan Chiller System having Liquid Coolant in Direct Contact with Dividing Walls by Lintker et al. issued on Jun. 30, 2015 does apply coolant to walls that are in contact with a food cooling area. Unfortunately, the Lintker system is burdened with an awkward and inefficient configuration of hollow divider bars that add bulk, voids for condensation and obstacles to the flow of cooling fluids. Lintker's penchant for internal ribs and fins also adds inefficiencies in both cooling and maximizing cooling the size of cooling compartments.

With respect to the multi directional blower and condenser aspects of the disclosed embodiments:

U.S. Pat. No. 9,242,525 by Kobayshi and issued on Jan. 26, 2016 teaches multi directional blowing in a rotational assembly wherein a condenser coil and evaporator coil rotate around an elongated shaft. While Kobayshi does provide directed outlets, Kobayshi fail to teach or anticipate the multiple directions of air flow enabled by the presently disclosed embodiments. Moreover, Kobayshi adds complexity and mechanical challenge in refrigeration since Kobayshi requires the use of balancing weights, a feature not needed in the disclosed embodiments.

U.S. Patent Publication 2014/0360221 by Kyle et al and published on Dec. 11, 2014 discloses a refrigeration system suited for small boats. Kyle uses a self-contained system taking the shape of a hollow cylinder. While Kyle appears to be well suited for compact spaces, Kyle fails to teach, suggest or disclose means or methods of accommodating varying directions of air flow as needed in land based commercial settings.

U.S. Pat. No. 8,117,864 by Montminy et al and granted on Feb. 21, 2012 discloses modular and compact air conditioning systems used in small carts for air craft support. While the Montminy system is compact, the system does not contemplate, anticipate or suggest the use of a housing system to allow for quick adjustment of air flow direction or multiple mounting positions.

BRIEF SUMMARY OF THE INVENTION

With respect to the pan chiller aspects of the disclosed embodiments:

In the prior art, traditional pan chillers typically comprise refrigeration tubing wrapped around and strapped or otherwise fastened to the inner liner of the pan chiller. While this prior art process works, there are inherent shortfalls in disposing round tubing strapped to the flat surface of a pan chiller wall. The prior art configuration of applying a round cooling tube to a flat surface results in 97% of the tubing not touching the surface to be chilled. Thus, energy is wasted.

Moreover, prior art systems are controlled is by a temperature control bulb strapped to a suction line. Measuring temperature at or within a suction line results in temperature readings that are not representative of the glycol or other coolant flowing within the inner walls of the pan chiller, resulting in the compressor turning on and off more frequently than necessary. Thus, the presently disclosed embodiments use less energy and inflict less wear and tear upon the compressor.

The disclosed embodiments overcome shortfalls in the related art by providing an improved inner tank liner with cambered corners and specialized drains disposed anywhere upon the bottom of the liner.

The disclosed embodiments overcome shortfalls in the related art by providing a new outer tank liner the may comprise tig welds, copper studs disposed upon the sides and bottom of the liner with the addition of unique breaker strips to artfully retain the refrigeration lines within the void of the outer thank liner and away from the sides of the outer tank liner. Thus, the refrigerant lines have maximum surface area to cool the coolant or refrigerant disposed within the new outer tanks. The copper studs and breaker strips avoid the prior art practice of placing round refrigerant lines upon the flat surfaces of a tank liner. The breaker strips avoid unwanted thermal transfer from the refrigerant lines to the tank liner and instead direct thermal transfer from the refrigerant lines to the refrigerant or coolant within the voids of the outer tank liner.

The breaker strips are configured so as to avoid or minimize thermal transfer from the refrigerant lines, through the breaker strips, through the copper studs and into a specific point of the tank. By dispersing thermal transfer from the refrigerant lines into the coolant of the tank, the coolant more evenly cools the pan chiller. Without the artful breaker strip system, the pan chiller would be compromised with uneven cold spots.

The disclosed breaker strip system may comprise a breaker strip, a void defined within the breaker strip, the void filled with a copper stud, the copper stud attached to an inner wall and the copper stud securing a thermal bracket, the thermal bracket comprising a flat planar section, the flat planar section defining a void to accept the copper stud, the thermal bracket further defining a clasp clamp to secure a refrigerant line. Thus, a refrigerant line is disposed within a glycol tank with the refrigerant line have little direct thermal transfer to an inner wall of the tank.

The disclosed embodiments overcome shortfalls in the related art by the disclosed outer shell liner which is sometimes used to retain insulation, such as blown foam insulation.

The disclosed embodiments overcome shortfalls in the related art by the disclosed beauty ring or finish collar that is sometimes used to join or attach the inner tank and outer linter together for mounting purposes. The finish collar provides advantages in efficient manufacturing, assembly and thermal transfer.

The disclosed fill tube may be welded to the bottom of the outer tank liner and enables efficient filling of the tank with glycerin, glycol or other coolants or refrigerants.

The disclosed overflow tube may be welded or otherwise attached to the to the bottom of the outer tank liner. The overflow tube may sometimes be referred to as a "pipe" and may extend up into the tank and stop 3⁄16" of inch from the top of the tank. The overflow tube provides reliable indications as to when the tank is full of glycerin or glycol. Upon overflow, the tank is considered to be full or at maximum capacity.

The disclosed drain tube may be welded or otherwise attached to the bottom of the inner tank liner. The drain tube may also be welded or otherwise attached to the bottom of the outer tank liner since the drain tube passes through the tank.

The disclosed embodiments overcome shortfalls in the related art by the configuration and use of the disclosed temperature probe well tube that may comprise stainless or copper tube that is welded or otherwise attached to the bottom of the outer tank liner. The tube may extend into the tank approximately two inches from the top of the tank. The top of this tube may be welded closed. The temperature control bulb may then be placed inside the tube and to the top. The bottom of the tube may be sealed silicone to hold probe in place.

The disclosed embodiments overcome shortfalls in the related art by the configuration and use of the disclosed fan motor that may be an axle style with moisture protection. This fan moves air around in the pan chiller. Pan chillers of the prior art do not move air and the cold air stays at the bottom of the pan. The disclosed embodiments move the cold air so the food chamber stays consistent no matter what size pans are in the chiller, the product or food will stay at a consistent temperature.

Disclosed embodiments include a mega style pan chiller is a pan chiller that holds a full-size pan from front to back or bigger. For this embodiment a low velocity fan may be added to move air throughout the pan. This feature helps keep a consistent food temperature on the bigger pans.

The disclosed embodiments overcome shortfalls in the related art by the unique placement and construction of an air chamber that is partially defined by an outside wall of a glycerin tank or coolant tank, with the coolant tank partially defined by an outer side of inner tank liner with the inner side of the inner tank liner used to define a void for food storage trays. Thus, air is blown upon and over the coolant tank and then into the food storage area. The disclosed air chamber is further improved by use of an angled bottom, having an angle in the range of 10 to 40 degrees wherein air is supplies at a deep end of the air chamber with the bottom of the chamber angled upwards at the air passes along the coolant tank, and eventually reaching horizontally disposed air flow voids that may pass over the coolant thank and into the food chamber.

The disclosed embodiments may use glycerin and/or propylene glycol in the coolant tank.

With Respect to the Multi Directional Blower and Condenser Aspects of the Disclosed Embodiments:

The disclosed multi directional blower and condenser embodiments overcome shortfalls in the related art by presenting an unobvious and unique combination, configuration and use of mounting brackets, housing configurations, fan motors, shaped discharge of blown air, and other features to create a versatile system that is well suited for a myriad of commercial environments.

The known related art fails to disclose, suggest or teach the use of the disclosed coil and fan mounting systems wherein two or so mounting brackets can be used interchangeably within the system to allow for multiple mounting positions, such as back wall mount, ceiling mount or a mullion style mount. The disclosed embodiments achieve advantages in manufacture by use of a frame or housing system that easily and nondestructively comports to many mounting positions and airflow configurations.

Objectives of the disclosed embodiments include the efficient manufacture of a line of evaporator coils that are energy efficient, quickly adaptable to fit into tight areas, extremely versatile, strong and compatible to the harsh environments evaporator coils are subject to in commercial environments, especially those in the food industry.

The disclosed embodiments may include multiple coils with varying BTU ratings. Various embodiments may be of the same height and depth and may use the same motors and other components.

A main assembly, housing or body may comprise a front cover, back panel, drain pans mounts and other components that may be comprised of 20-gauge 304 stainless steel or similar materials. Such materials and/or other disclosed features, give the disclosed embodiments the needed durability and longevity to survive in commercial food environments. The disclosed evaporator coils and other disclosed components are well suited for harsh environments wherein food and sauces may disburse acids and other contaminants that will corrode the systems of the related art. Said coils may be coated by dipping and baking so as to add longevity to the coils.

Disclosed embodiments include unique fan motors, motor bodies and impellers may be made of plastic or other non-corrosive materials so as not to rust or corrode. Disclosed motors may include ball bearing that comprise protective coatings to minimize water damage to the bearings. The disclosed motors may be RoHS II certified and/or are rated to operate at 100v-240v 50/60 hz. Disclosed motors may use or require .06 amps or less, which represents a meaningful improvement as compared to the related art. The blow pattern of a disclosed motor may comport to a cone shape. In a disclosed cone shaped discharge, the flow starts at the base of the motor and projects air outwardly in a cone shape. Disclosed cone shape discharges cover more area than a direct air pattern, as embraced by the prior art.

The disclosed embodiments include versatility in mounting and use of variable and multiple air blow directions. Disclosed coils can be efficiently mounted to a back-wall mount, ceiling mount, mullion style mount. The different mounting positions may be achieved with just two interchangeable mounting brackets. With said mounting brackets sometimes made from 304 stainless steel. The depth of the coils may be 4⅜" deep, allowing a disclosed coil to fit in areas where coils of the prior art would not fit. To make multiple mounting options feasible and to overcome air flow problems of the related art, disclosed embodiments allow for quick attachment or configuration of multiple fans to enable multiple air flow directions and multiple points of origin and destination of air flow. Embodiments may be quickly and nondestructively configured to blow air forward, up, and back. Moreover, multiple directions of air flow may be combined and may occur at the same time. The prior art fails to provide such quickly executed versatility. The prior art requires multiple fixed configurations that are selected or purchased separately for each anticipated mounting and blow pattern environment. Thus, the prior art has a significant shortfall in requiring vendors to purchase, store and stock multiple models, or special order a particular model.

REFERENCE NUMERALS IN THE DRAWINGS

Figure 1:
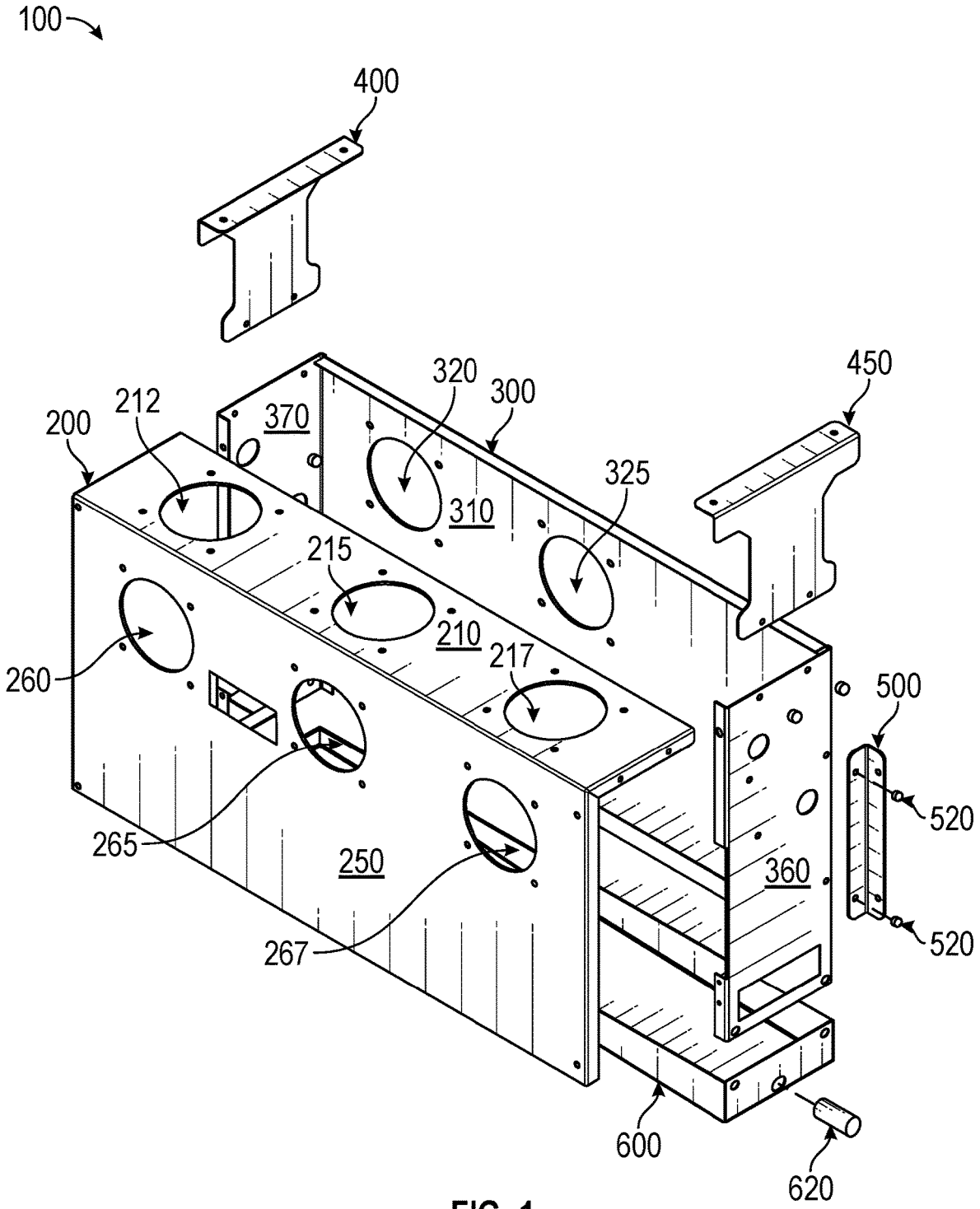
FIG. 1 exploded view of housing assembly
FIG. 2 perspective view of a wall mount configuration
FIG. 3 perspective view of a mullion mount configuration
FIG. 4 top view in a wall mount configuration
FIG. 5 front view in a wall mount configuration
FIG. 6 end view in a wall mount configuration
FIG. 7 rear view in a mullion mount configuration
FIG. 8 perspective vie of front plate
FIG. 9 side edge assembly of front plate from FIG. 8
FIG. 10 expanded view of fastener detail from FIG. 9
FIG. 11 perspective view of a mullion mount bracket
FIG. 12 perspective view with front plate removed
FIG. 13 back plate with coil installed
FIG. 14 various internal components
FIG. 15 back plate and front plate of a horizontal embodiment
FIG. 16 front view with front fans installed and top fan voids covered
FIG. 17 perspective view of a cooling side of a horizontal embodiment
FIG. 18 perspective view of a drainage end of a horizontal embodiment
FIG. 19 inner side of a front plate for a horizontal embodiment
FIG. 20 outer side of a front plate for a horizontal embodiment
FIG. 21 top view of a pan chiller configuration
FIG. 22 sectional side view of a pan chiller configuration
FIG. 23 sectional end view of a pan chiller configuration
FIG. 24 top view of a pan chiller configuration showing directions of thermal flow
FIG. 25 sectional view of a pan chiller configuration showing directions of thermal flow
FIG. 26 sectional view of a pan chiller configuration
FIG. 27 top sectional view of a pan chiller configuration
FIG. 28 side sectional view of a pan chiller configuration
FIG. 29 sectional end view of a pan chiller configuration with optional fan
FIG. 30 sectional end view of a pan chiller configuration
FIG. 31 sectional end view of a pan chiller configuration
FIG. 32 sectional end view of a pan chiller configuration with freon lines or coolant lines shown
FIG. 33 center sectional view of a pan chiller
FIG. 34 sectional side view of a pan chiller
FIG. 35 sectional view of a thermal retention assembly

100 housing assembly
200 front plate of housing assembly
203 front plate of a horizontal embodiment
204 drainage wall of front plate 203 for horizontal embodiment
205 drainage creases for front plate of a horizontal embodiment
207 a horizontal embodiment in general
210 top ledge of front plate 200
212 first top void defined within top ledge 210
215 second top void defined within top ledge 210
217 third top void defined within top ledge 210
250 side wall of front plate 200
260 first side void defined within side wall 250
265 second side void defined within side wall 250
267 third side void defined within side wall 250
280 lateral edge piece
285 tig weld at transition junctions of lateral edge pieces
290 instrument reading void defined within the side wall or front wall of the front plate
293 lower edge or lower edges of front plate
300 back plate of housing assembly
310 vertical wall of backplate
320 first void defined within vertical wall of backplate
325 second void defined within vertical wall of backplate
360 left side wall of back plate
370 right side wall of back plate
380 lower edge or lower edges of back plate
400 first mullion mount bracket
410 top horizontal plate of mullion mount bracket 400
421 vertical extension section of mullion mount bracket
425 transition jog between vertical extension section 421 and lower mount plate 430
430 lower mount plate of mullion mount bracket 400
450 second mullion mount bracket
470 housing in a mullion mount configuration
500 back support angle
520 fastener such as a button rivet
550 housing in a wall mount configuration 720
600 drip pan
620 drain tube of drip pan

630 air circulation void defined by upper edges of drain pan and lower edges of front plate and back plate
635 upper edge or upper edges of drip pan 600
700 fan
720 protective cage for fan
730 void cover, in area sometimes used for a fan 300
800 evaporation coil
900 pan chiller in general
910 outer shell
930 outer air chamber
950 outer tank liner
970 air chamber
990 inner tank liner
991 air flow void to cool food, void defined within inner tank liner 990
992 lower angled boundary of inner tank liner
995 inner air chamber
1000 coolant tank, glycerin/glycol tank or void defined between the outer tank liner 950 and inner tank liner 990
1020 food storage tray
1030 void for food storage trays
1050 directional arrow of air flow
1200 beauty ring
1210 outer edge of beauty ring
1300 thermal retention assembly to retain coolant line 1350
1310 thermal breaker strip
1320 clamp assembly
1322 flat or planar section of clamp assembly 1320
1325 clamp fastener, sometimes used to retain a coolant line
1330 mounting stud
1350 coolant line or refrigeration line
1400 fan motor
1500 insulation or void for insulation
1600 fill tube
1620 drain line
1650 overflow tube
1700 temperature control well
1800 food well These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a housing assembly 100 may include a front plate 200, a back plate 300, a drip pan 600. At least two mounting options are easily configured without breaching the inside of the housing. For a back mount application, a first and second back support angle 500 may be attached to the back plate. The back support angle may then be attached to a wall or other environmental element. An advantage of the disclosed embodiments is that a unit may be sold with both a set of mullion mount brackets 400 and back support angles 500 at little additional cost. Such a configuration allows an end user or installer to make an onsite decision as to a mounting position without having to open the housing.

Figure 13:
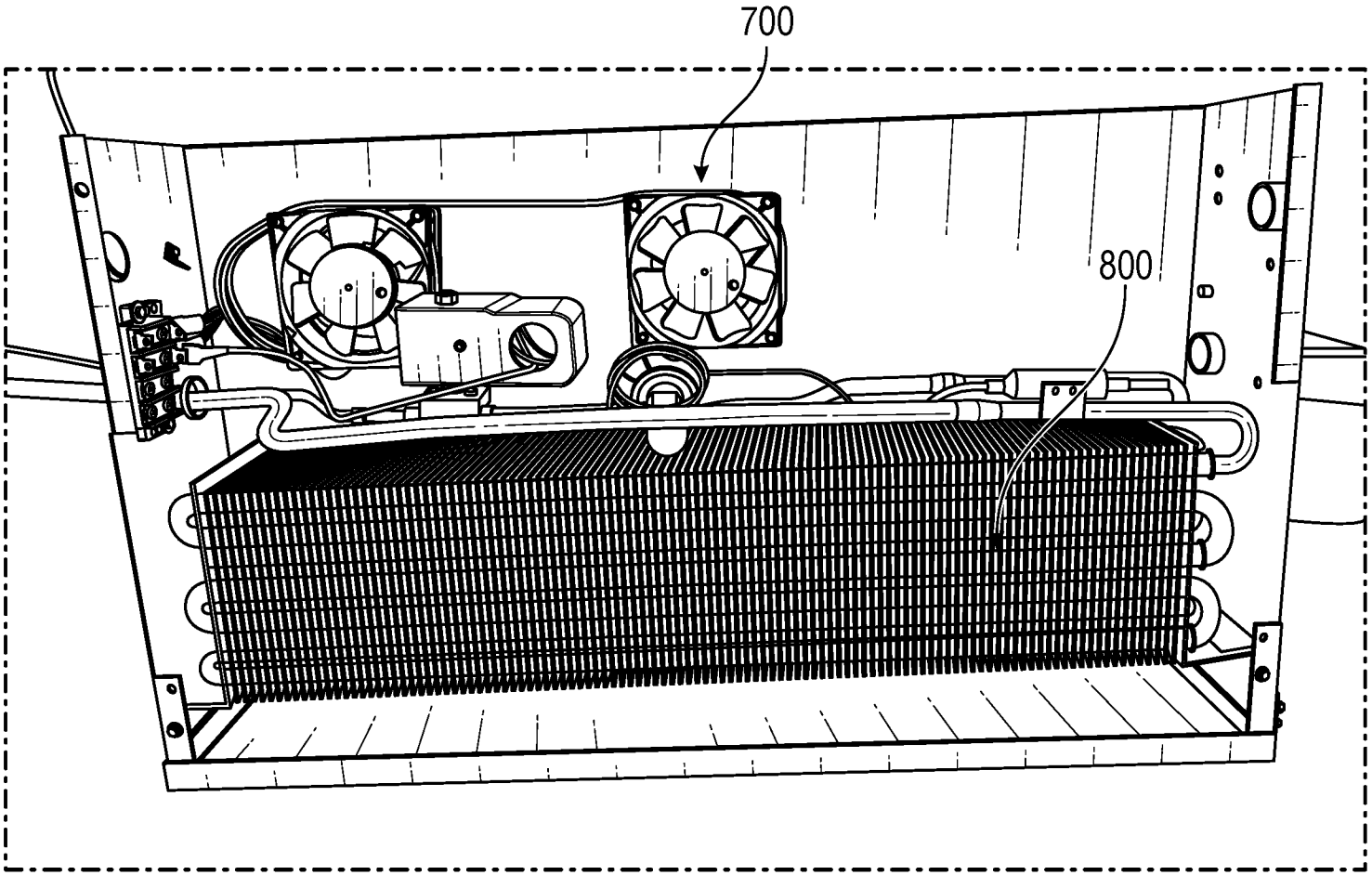
Figure 15:
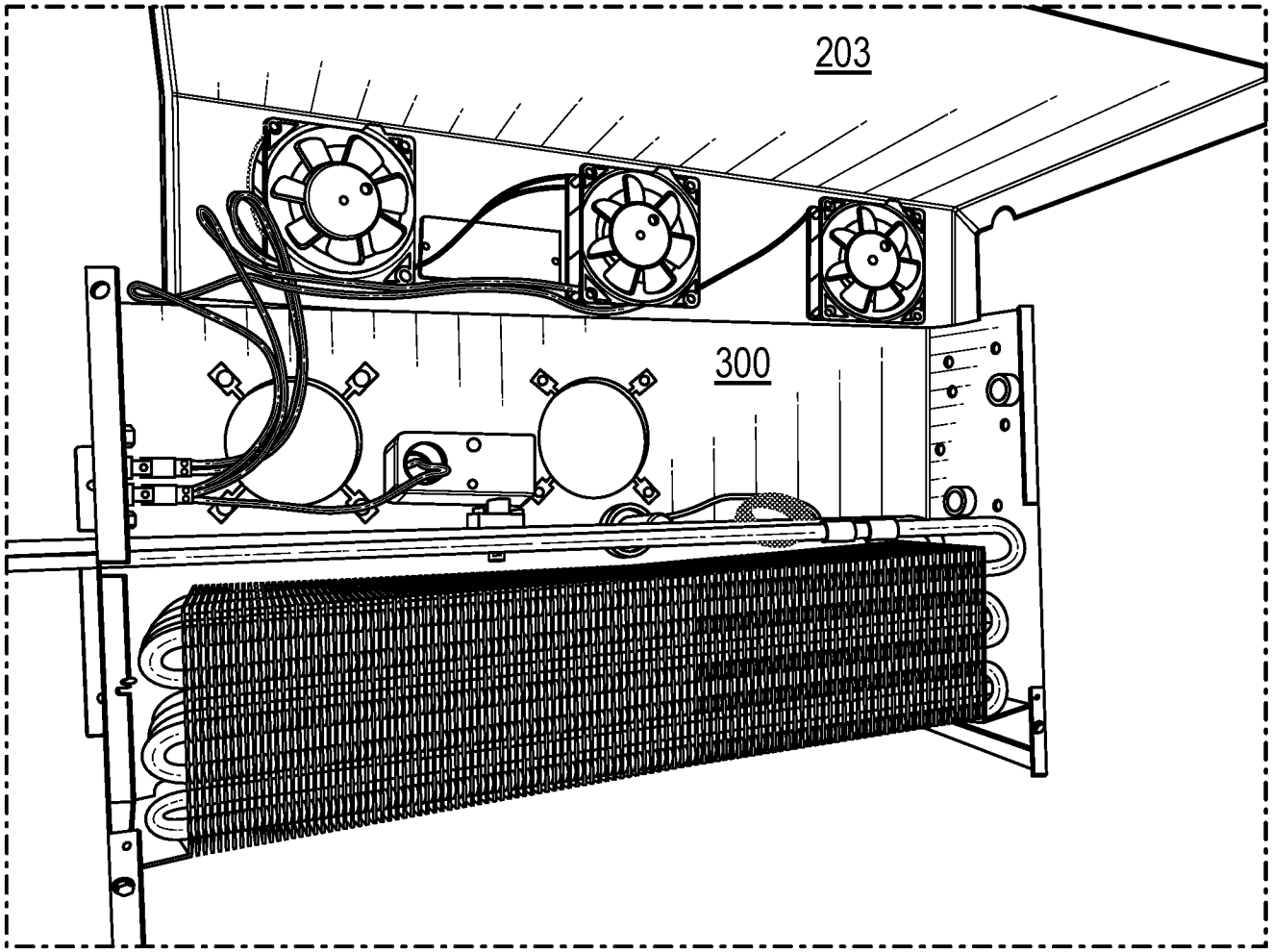

A further advantage over the prior art is that the disclosed embodiments may include a plurality of fan voids with the fan voids being defined within three different surfaces with each surface disposed on a different plane. Each fan void may be filled with a fan or a void cover. Each fan void may be filled or equipped with a fan with such installation not requiring a movement or reinstallation of a coil. A coil, as shown in FIG. 13, a coil is disposed within a lower section of a back plate, allowing the fan voids of the back plate to be covered or filled with fans without disturbing the installed coil. Since there are few or no parts installed upon the front plate, the voids of the front plate are easily covered or filled with fans. Due in part, to the combination of housing assembly elements, the front and back plates may be removed or attached to one another with ease, as shown in FIG. 15.

Figure 9:
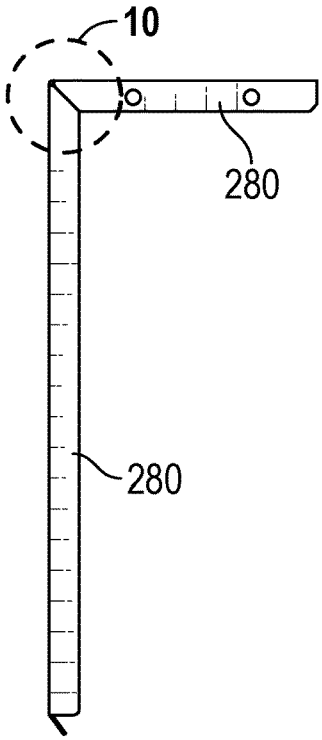

Referring to FIG. 1, a front plate 200 may comprise a top ledge 210 with the top ledge defining a first top void 212, a second top void 215 and a third top void 217. A front plate may also comprise a side wall 250 or front wall, with the side wall sometimes defining a first side void 250, a second side void 265 and a third side void 267. The sides or lateral edges of the front plate may comprise a bent lip or lateral edge pieces, as shown in FIG. 9 in reference number 280.

A backplate 300 may comprise two side walls such as a left side wall 360 and a right sidewall 370 with the terms "left" and "right" being interchangeable. A backplate may further comprise a vertical wall or back wall which may define a first void 320 and a second void 325. An advantage of the disclosed configurations is that both the back support angles 500 and mullion mount brackets 400 may be attached to the back plate only, allowing the front plate to be removed for unit servicing without having to dismount the unit from the wall or ceiling.

Figure 2:
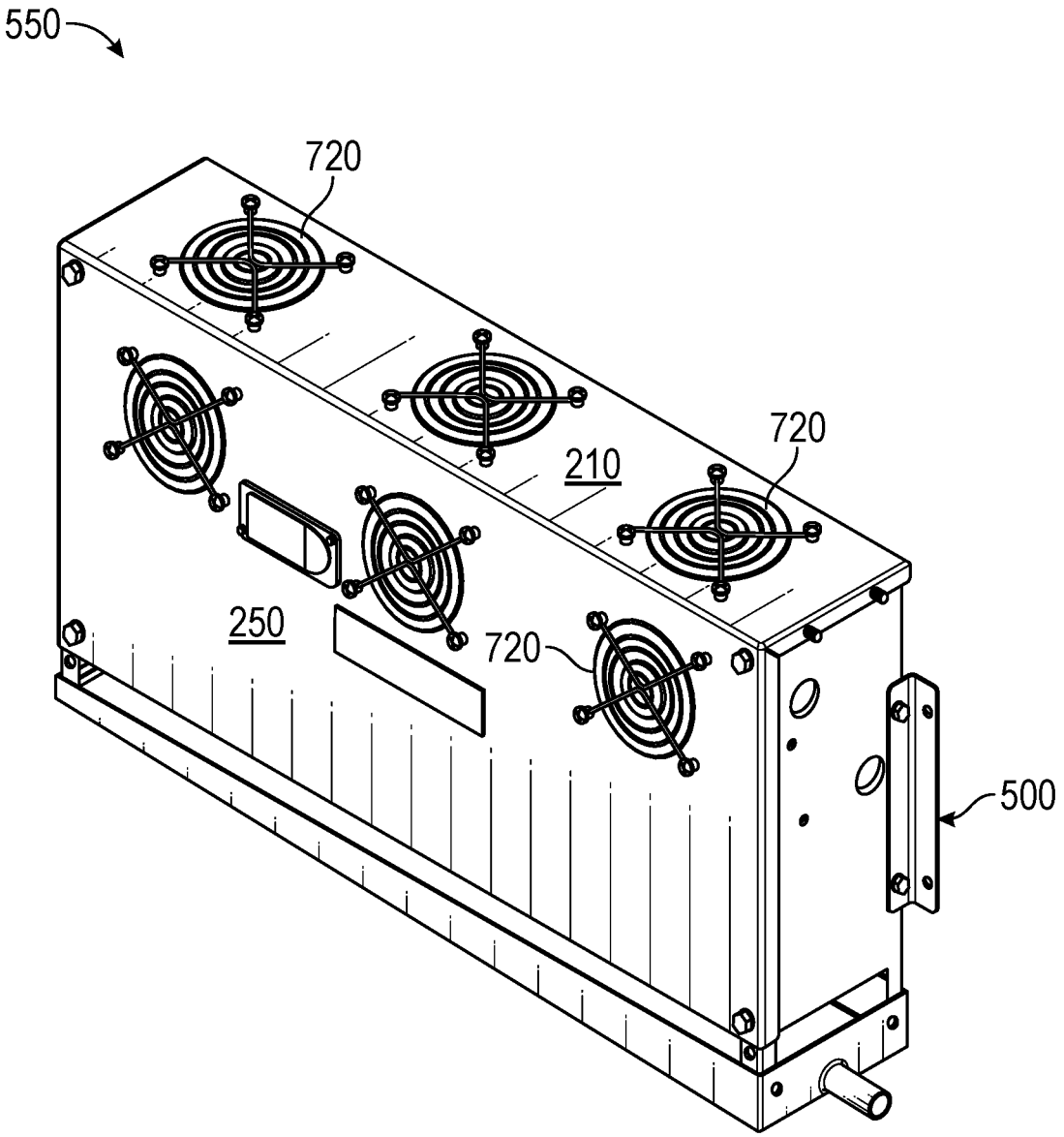

Referring to FIG. 2, a perspective view of an assembled embodiment is illustrated with fans disposed in three voids of the side wall 250 or front wall of the front plate and three voids of the top ledge of the front plate are used to secure fans as well. In this illustrated configuration, air is blown in both front and upward directions.

Disclosed embodiments overcome shortfalls in the related art by use of air circulation voids 630 which may be defined by upper edges 635 of the drain pan and front plate lower edges 293 and back plate lower edges 380. The circulation void or circulation voids are artfully created by using the native edges of the back plate, front plate and drain pan so as to not require any modifications to the housing components. Superior intake air flow is achieved by the circulation void(s) in that the circulation voids are distal from the fan voids and fans so as to draw air over the internal coil.

Figure 3:
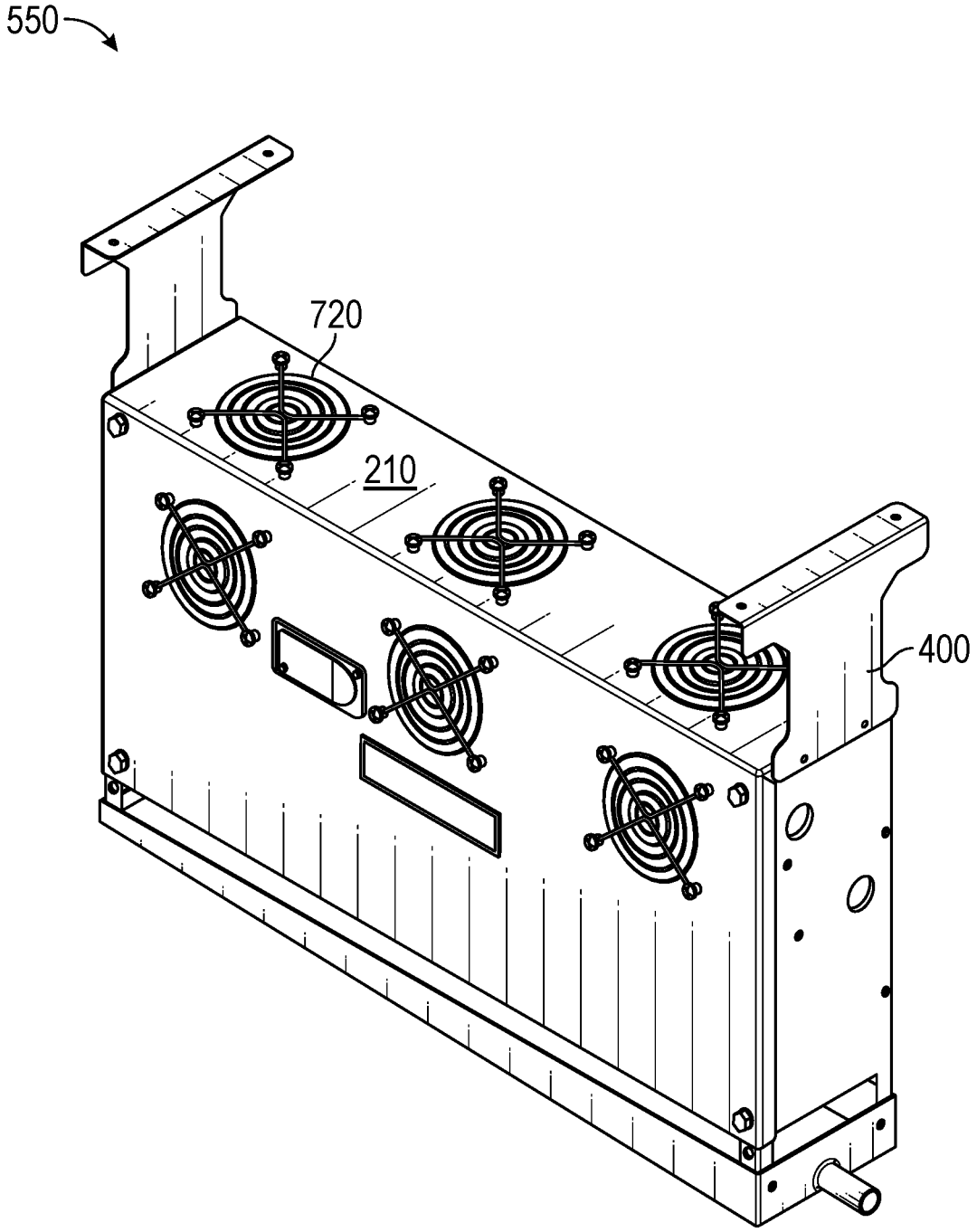

FIG. 3 is similar to FIG. 2, except a wall mount configuration 550 is shown wherein a pair of mullion mount brackets are disposed on the superior section of the embodiment, allowing for ceiling installation.

Figure 4:
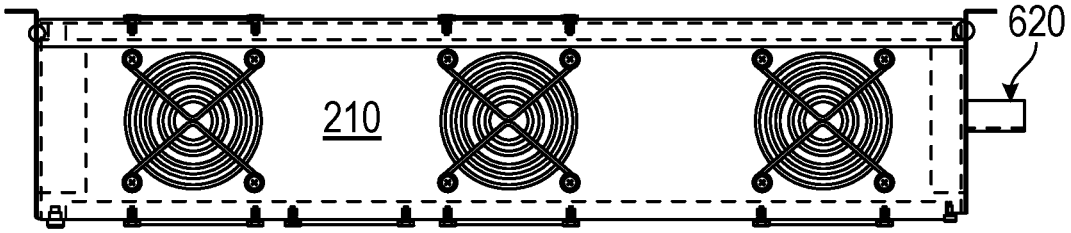

FIG. 4 depicts a top view of a top ledge 210 of a front plate or a top end component. The fans are shown to be installed for the upward movement of air.

Figure 5:
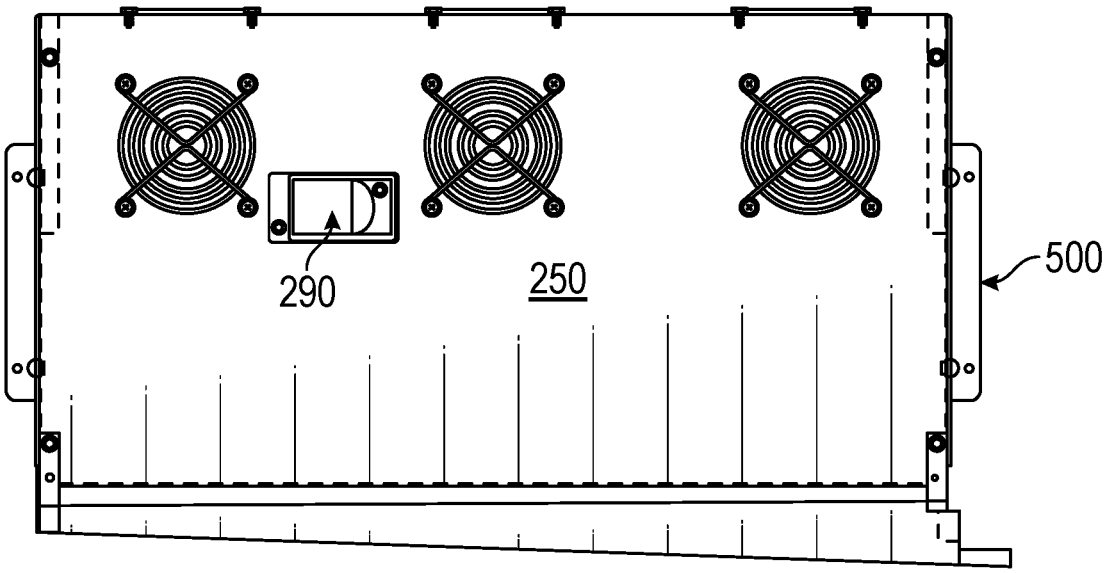

FIG. 5 depicts a front view of a disclosed embodiment with three fans installed for a front movement of air.

Figure 6:
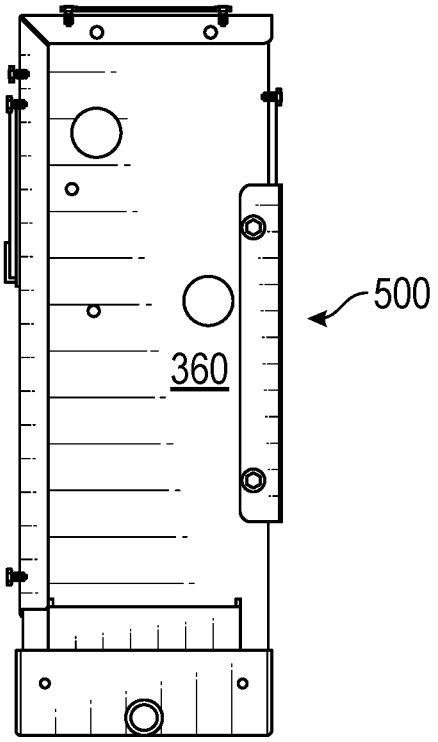

FIG. 6 depicts a side of a disclosed embodiment, or a view of a left side wall 360 of a backplate. A back support angle 500 is attached to the back plate.

Figure 7:
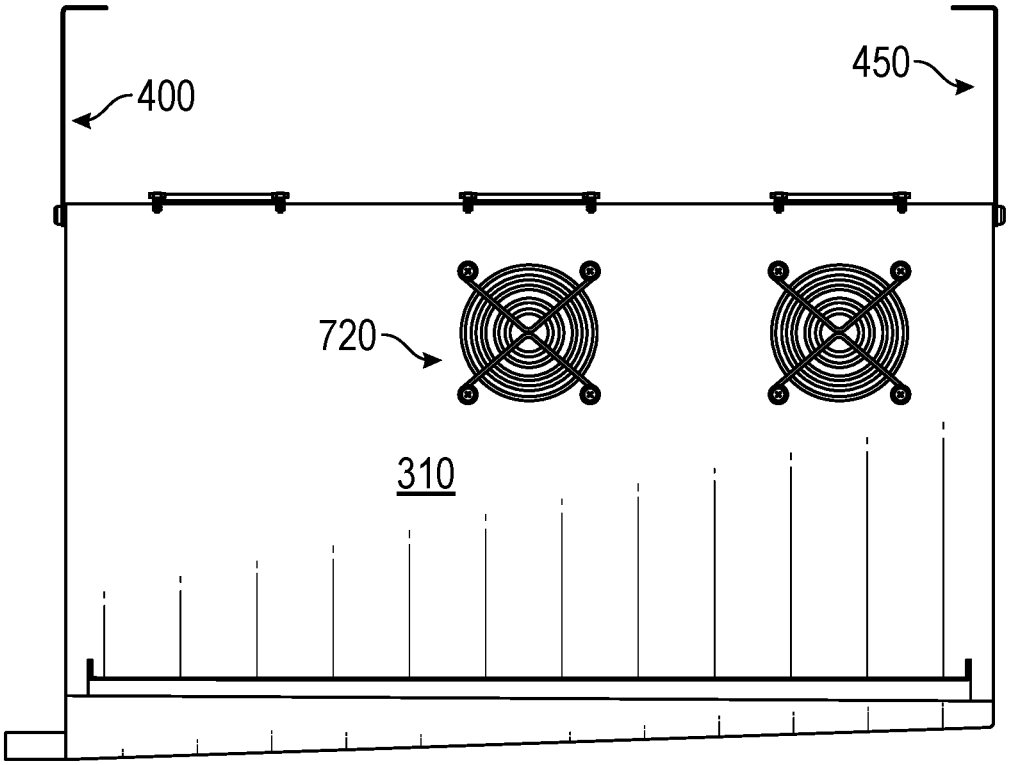

FIG. 7 depicts a back side of a disclosed embodiment with a fan disposed within or upon each of the voids defined with in the vertical wall 310 or back wall of the backplate. Such a fan configuration will result in a rearward flow of air.

Figure 8:
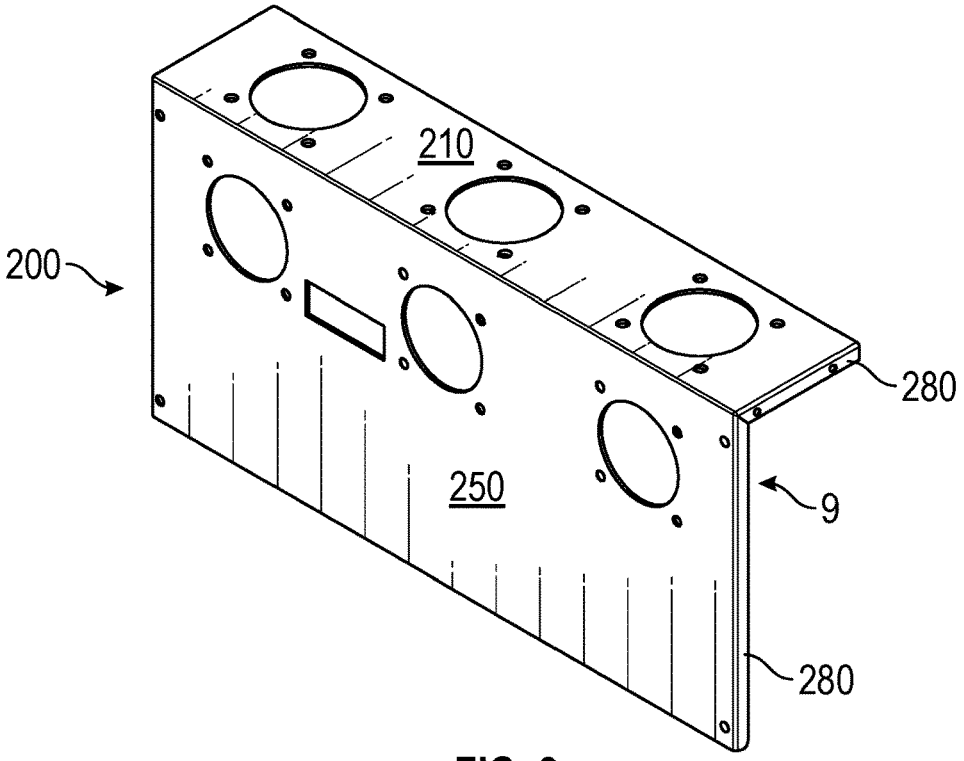

FIG. 8 depicts a front plate 200 or front cover comprising a lateral edge piece 280 or edge surface disposed at either lateral side of the front plate.

FIG. 9 more clearly shows lateral edge piece components 280.

Figure 10:
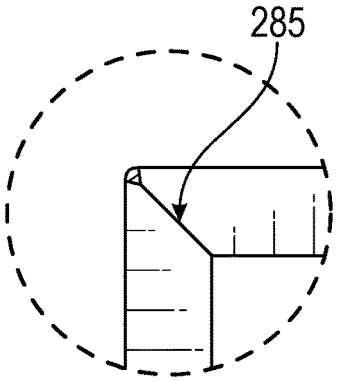

FIG. 10 depicts a joint or transition area of FIG. 9 and shows a tig weld 285 at said transition point.

Figure 11:
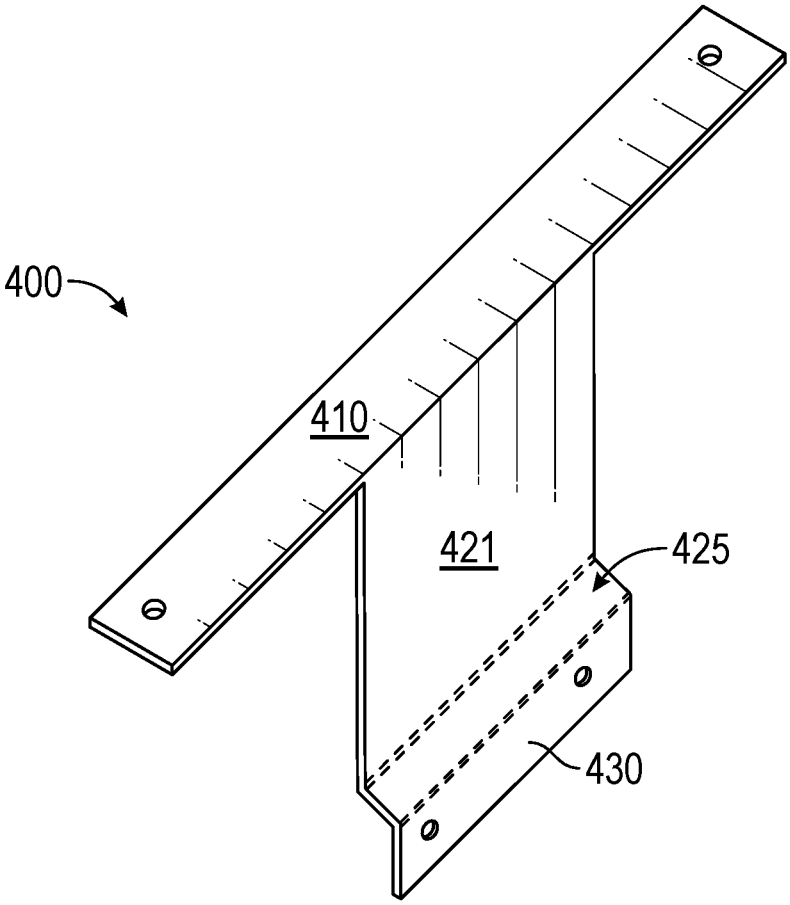

FIG. 11 depicts a perspective view of a mullion mount bracket 400 that may comprise a lower mount plate 430 attached at an inward angle to a transition jog 425 with the transition jog attached to a vertical extension section 421 with the vertical extension section attached to top horizontal plate 410. Said features of the mullion mount bracket overcome shortfalls in the related art by increasing ease of installation as the top horizontal plates 410 are disposed inwardly from the lateral sides of the backplate, allowing working room for insertion of fasteners through voids of the top horizontal plates. Thus, an embedment may be installed tightly at an interior corner and an installer will have room to access the top horizontal plate by virtue of the inward distance gained by use of the transition jog 425.

Figure 12:
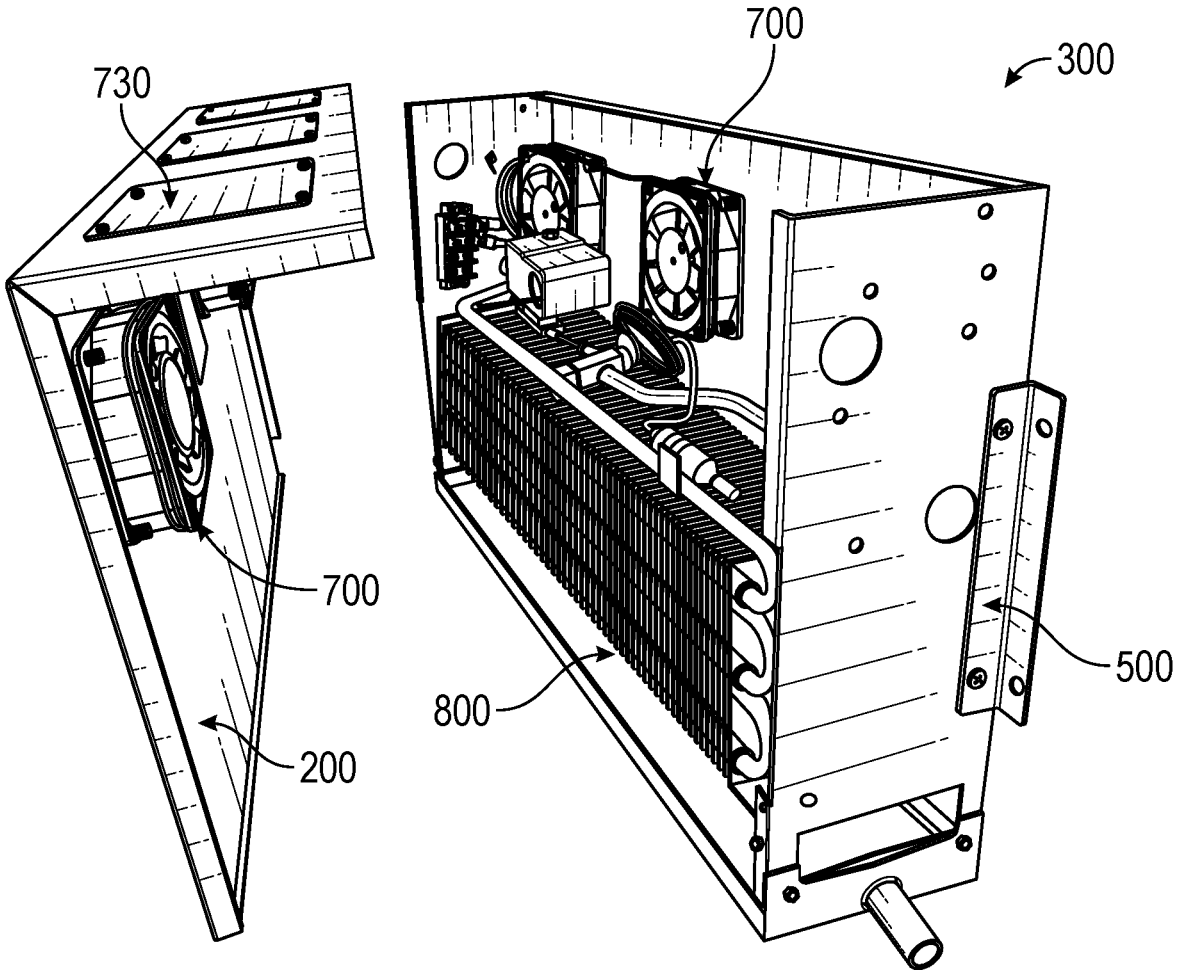

FIG. 12 depicts a front plate 200 being attached to a backplate 300 with fans 700 disposed within voids of the front plate and back plate. A coil 800 is disposed within the lower confines of the backplate so as to not interfere with the installation of either fans or void covers upon voids of the backplate. In this configuration, air will blow from both the front and back sides of the embodiment.

FIG. 13 depicts and evaporator coil disposed within a backplate.

Figure 14:
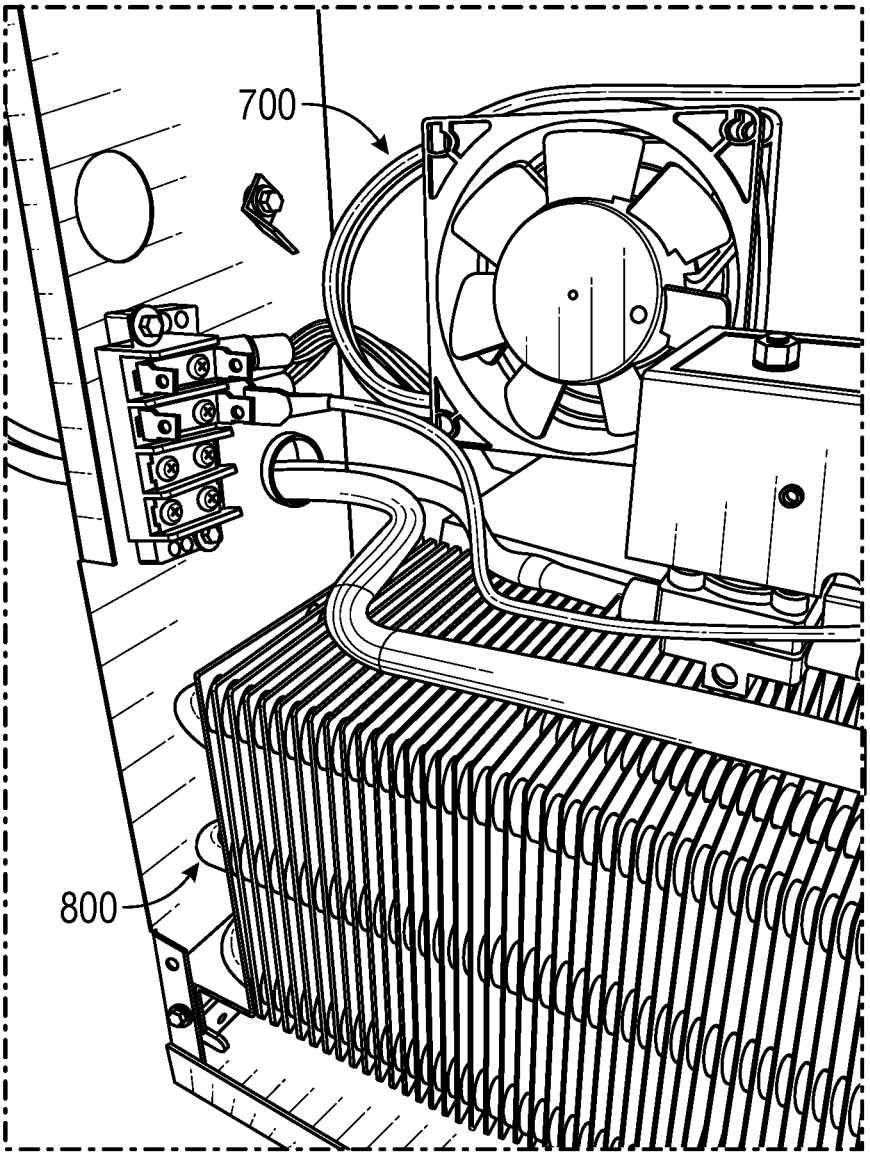

FIG. 14 depicts further components disposed within a backplate.

FIG. 15 depicts a front plate 203 of a horizontal embodiment in wired connection with a backplate 300.

Figure 16:
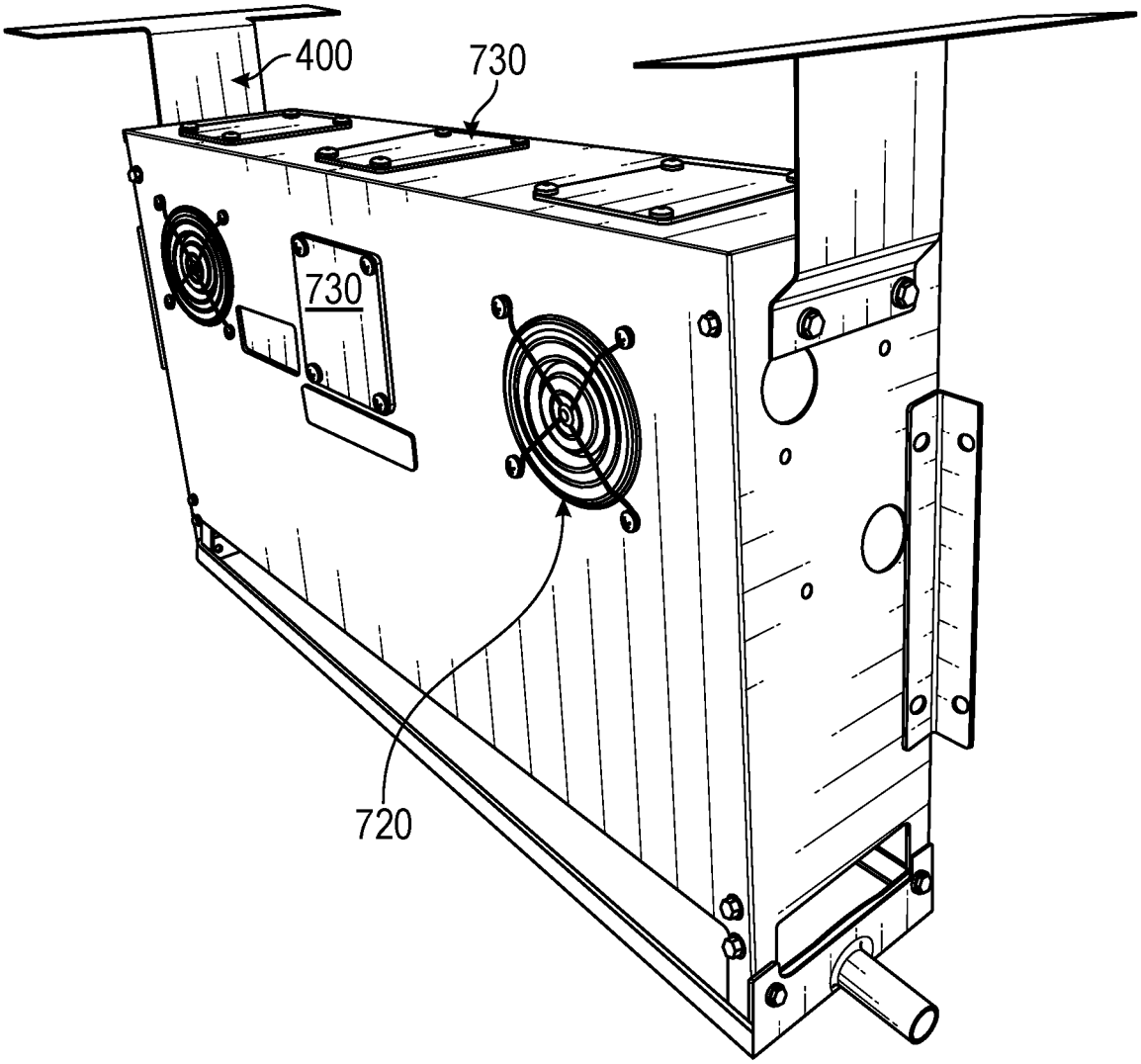

FIG. 16 depicts an embodiment ready for either mullion mounting or vertical surface mounting. Void covers 730 block fan voids in both the backplate and front plate.

Figure 17:
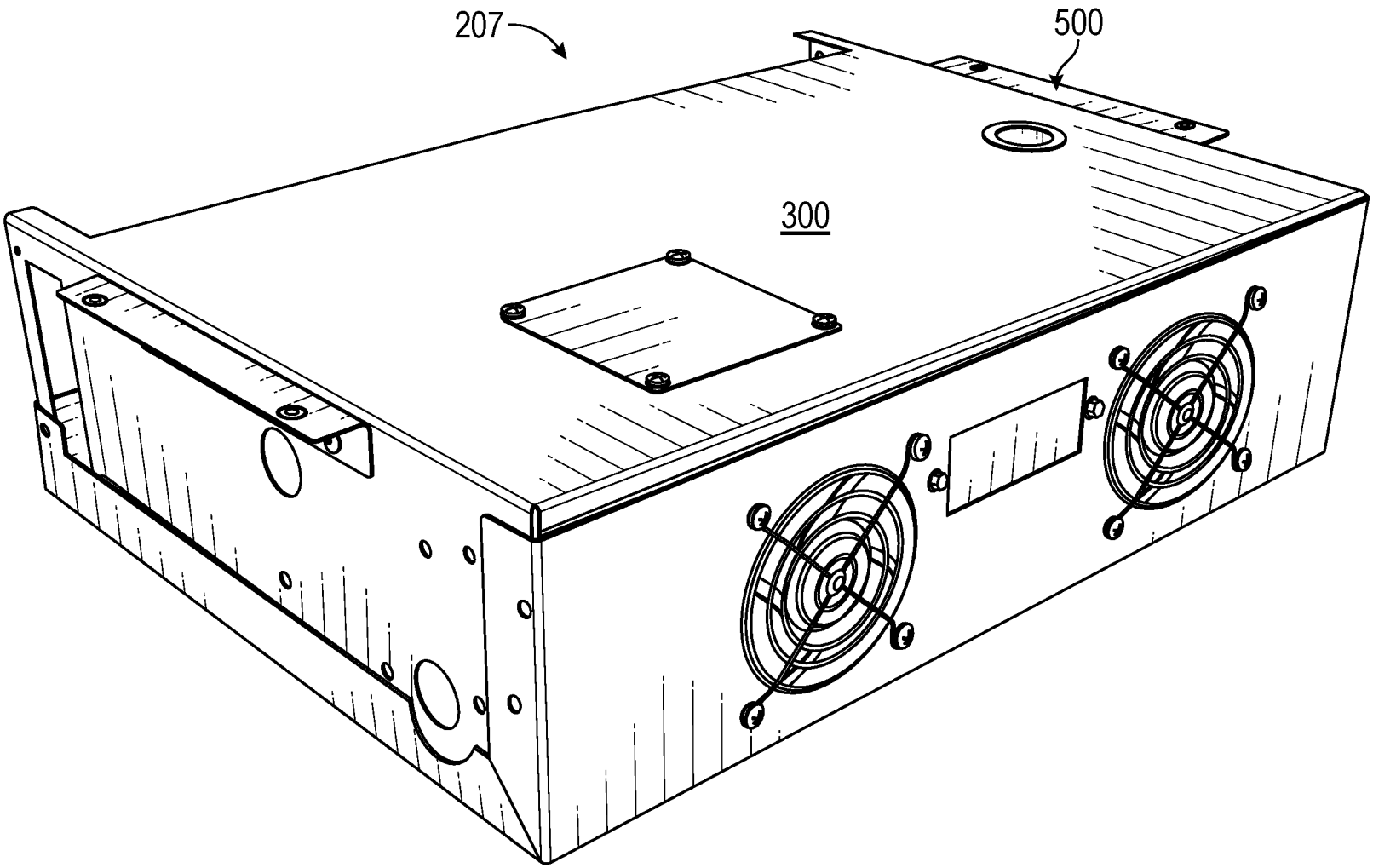

FIG. 17 depicts a horizontal embodiment 207 and the use of back support angles 500.

Figure 18:
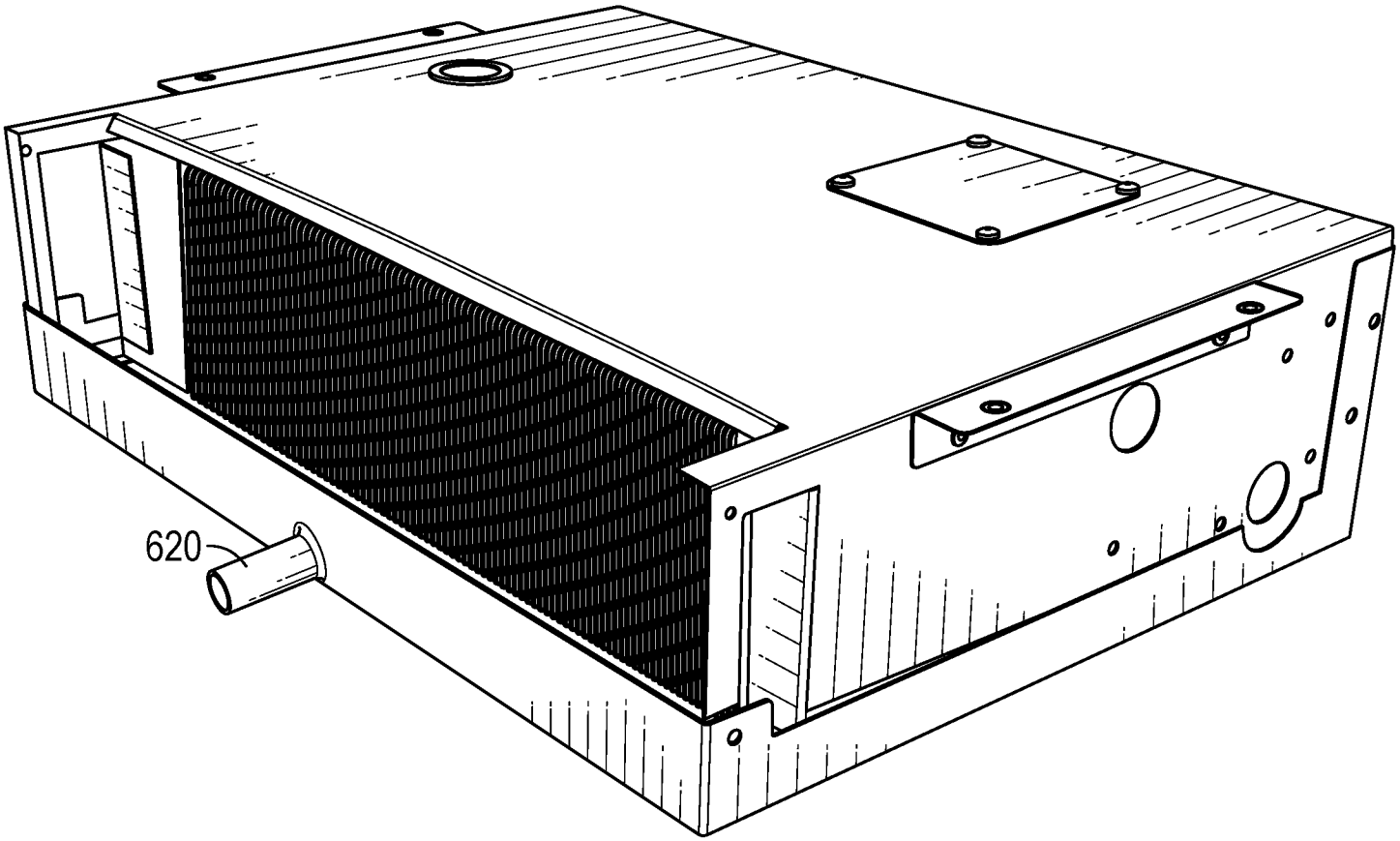

FIG. 18 depicts a horizontal embodiment with a horizontally disposed drain tube 620.

Figure 19:
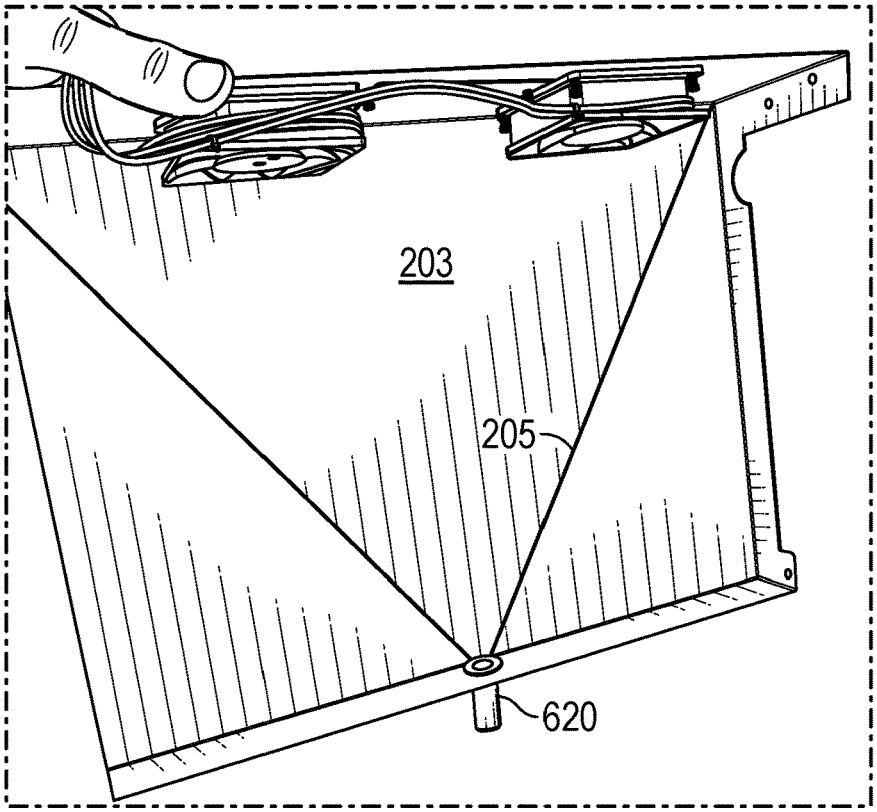

FIG. 19 depicts inside components or features of a front plate 203 for a horizontal embodiment, with the front plate 203 comprising drainage creases 205 or drainage valleys that provide guidance and slope for fluid drainage to the drain tube 620.

Figure 20:
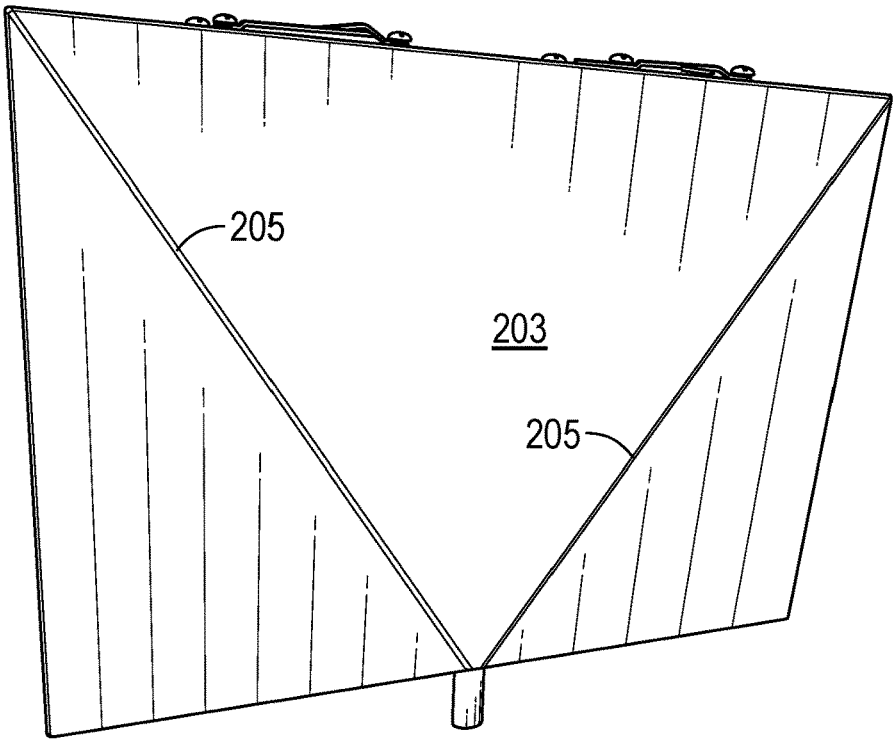

FIG. 20 depicts an outside surface of front plate 203.

Figure 21:
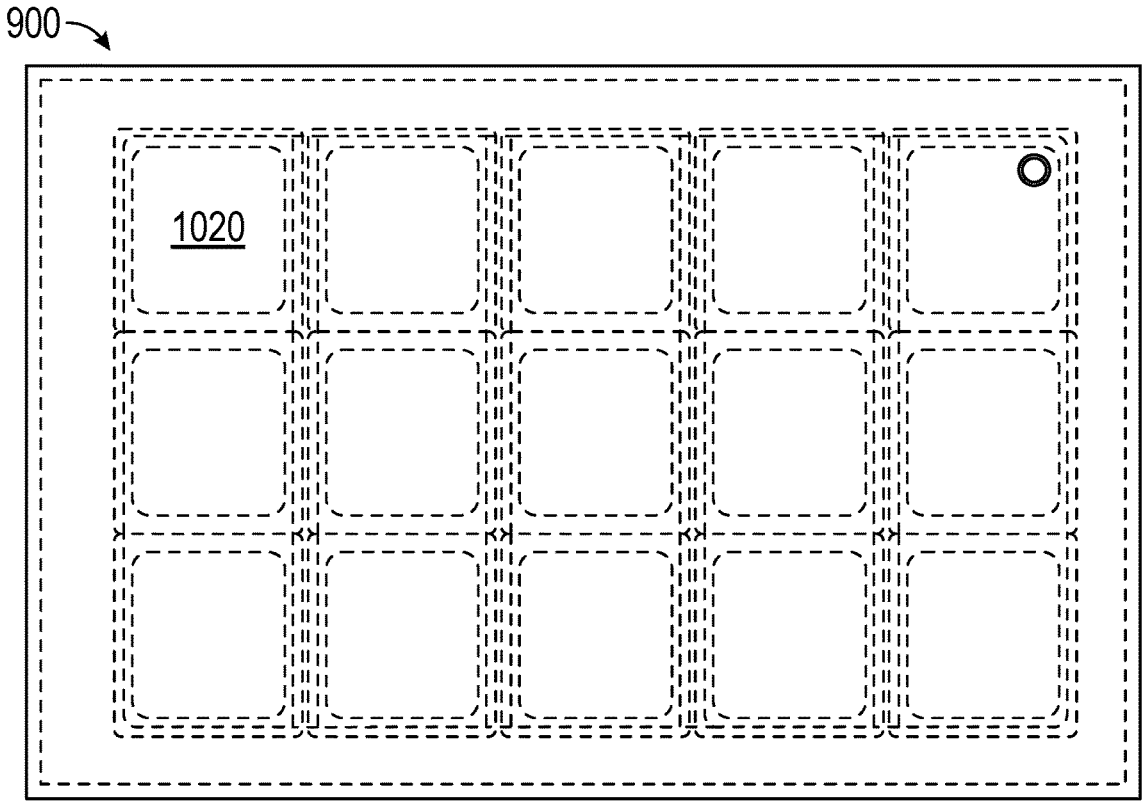

FIG. 21 depicts a top view of a disclosed pan chiller.

Figure 22:
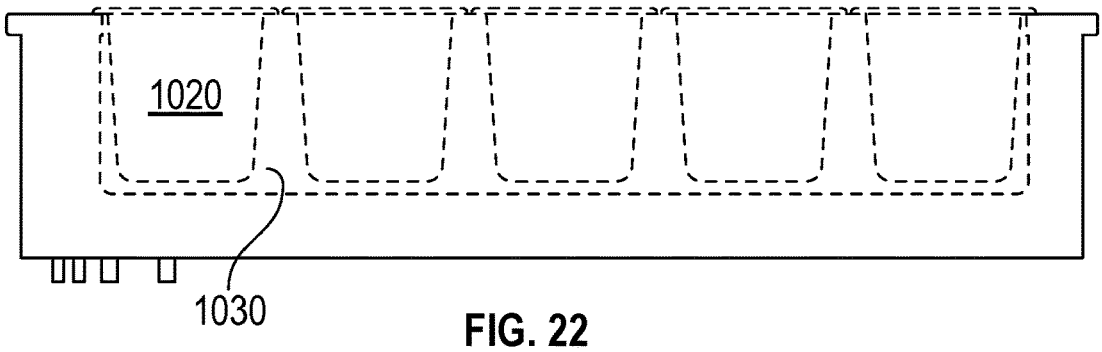

FIG. 22 depicts side sectional view of a disclosed pan chiller.

Figure 23:
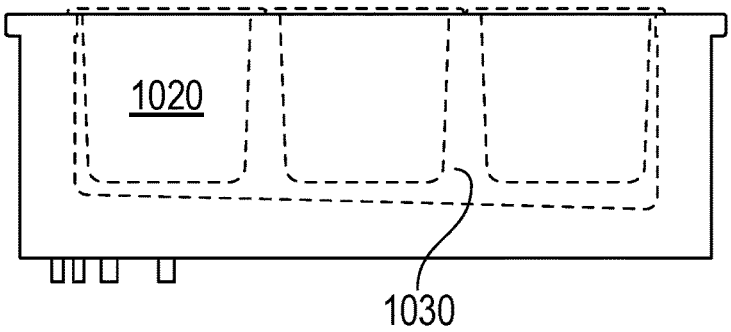

FIG. 23 depicts an end view of a disclosed pan chiller.

Figure 24:
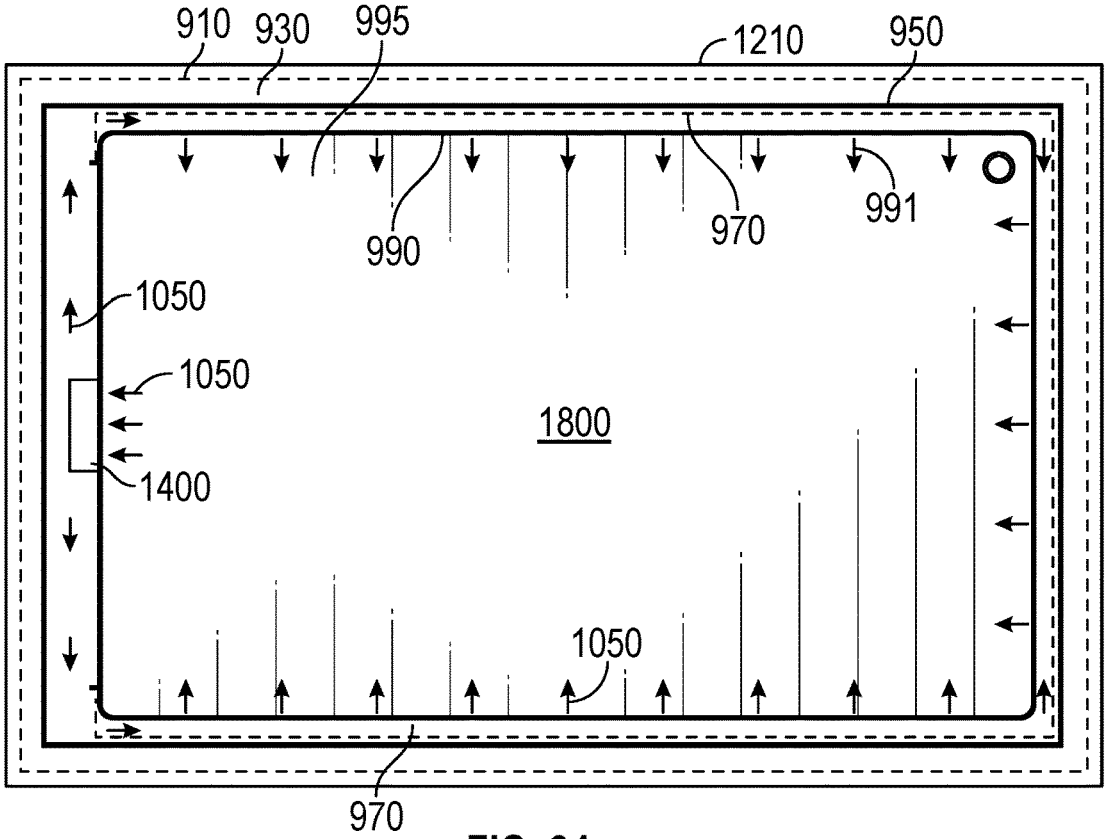

FIG. 24 depicts a top sectional view of a disclosed pan chiller and highlights the flow of air. Air flow may originate from a fan or fan motor 1400 with air drawn from a food well 1800. Air may then flow over and or upon the outer sides of an inner tank liner 990 with the inner tank liner having an interior side partially defining a coolant tank. Air is cooled by contact with the coolant tank and may be blown over the coolant tank and back into the food well.

Figure 25:
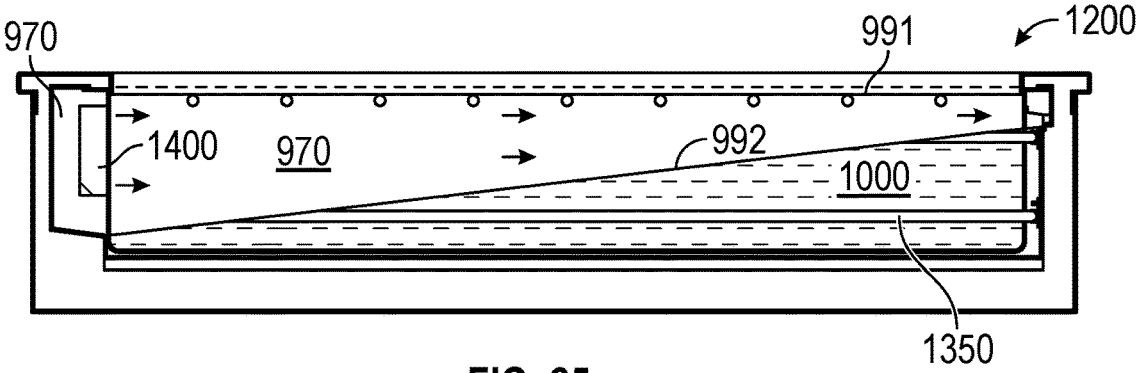

FIG. 25 depicts air flow from the fan motor or fan 1400 and flowing through the air chamber 970 the with the air chamber narrowing by use of the angled lower boundary 992. The air flowing through voids 991 defined by the inner tank liner 990. The air chamber 970 may be defined by the outer side of the inner tank liner 990, portions of an angled lower boundary 992 and the inner side of the outer tank liner 950. Portions of the air chamber may extend over and above the coolant tank The coolant tank 1000 may be defined between portions of the outer tank liner 950 and inner tank liner 990.

Figure 26:
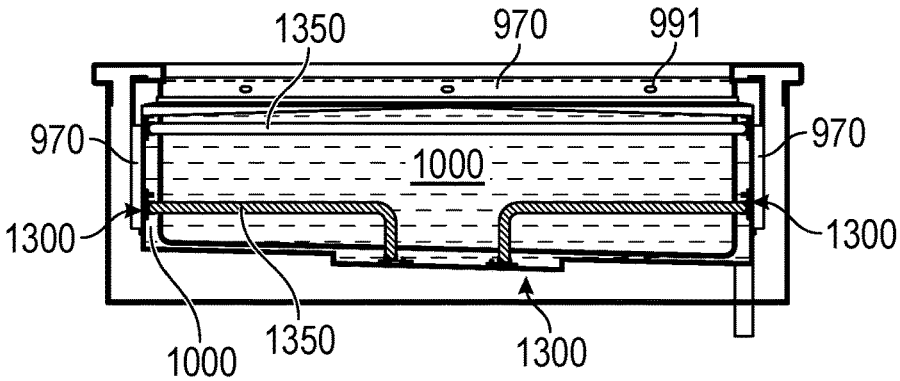

FIG. 26 depicts an end sectional view showing the close proximity of the air chamber 970 to the coolant tank 1000. The air chamber 970 may be disposed to the outside of the coolant tank or outer tank liner 950. The coolant tank may be optionally enclosed by a top cover, with air flow voids 991 passing air flow over the coolant tank and into the food well.

The coolant tank may contain a free flowing coolant and the coolant tank may contain refrigeration lines 1350 used to cool the coolant in the coolant tank. The refrigeration lines 135 may be artfully disposed within the coolant tank so as to avoid or minimize thermal transfer from the coolant lines directly into either boundary of the coolant tank so as to maximize the wanted thermal transfer from the refrigeration lines to the coolant in the coolant tank. A few locations of the disclosed thermal retention assembly 1300 are shown in FIG. 26 and elsewhere. The details of the thermal retention system are shown in FIG. 35.

Figure 27:
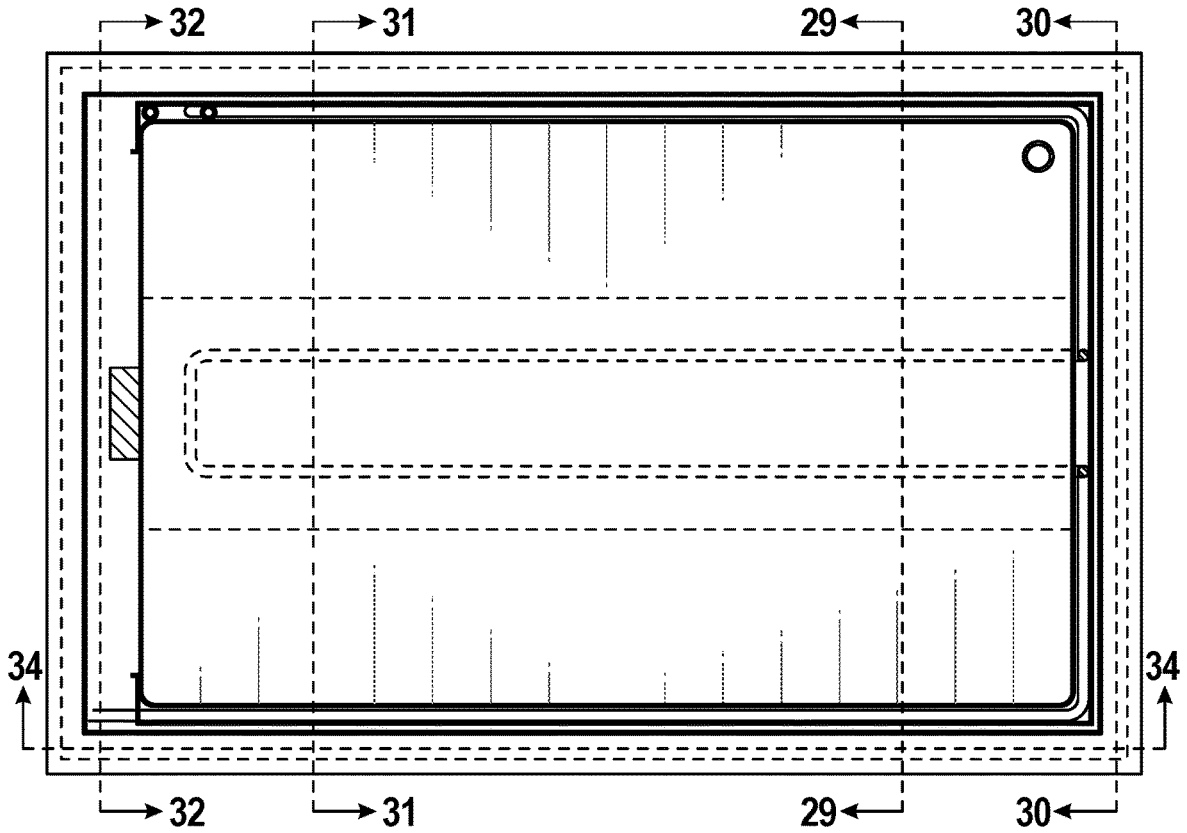
Figure 28:
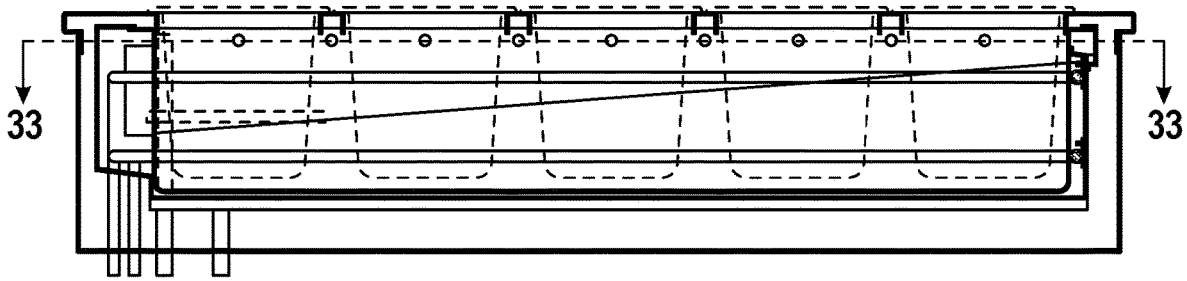

FIG. 27 depicts a side sectional view of a pan chiller

Figure 29:
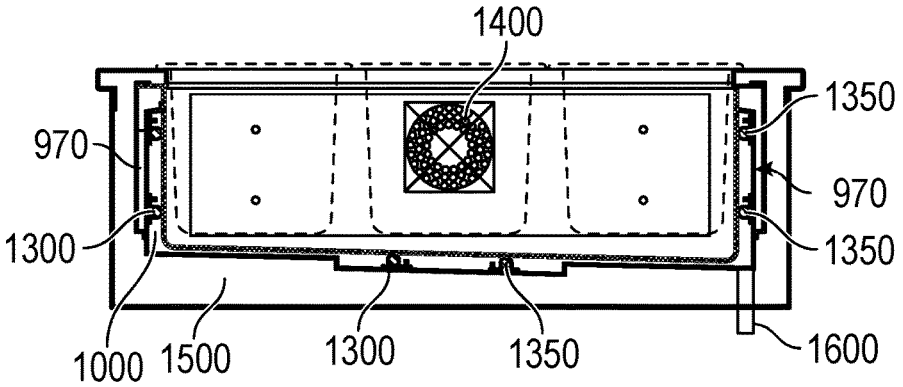
Figure 30:
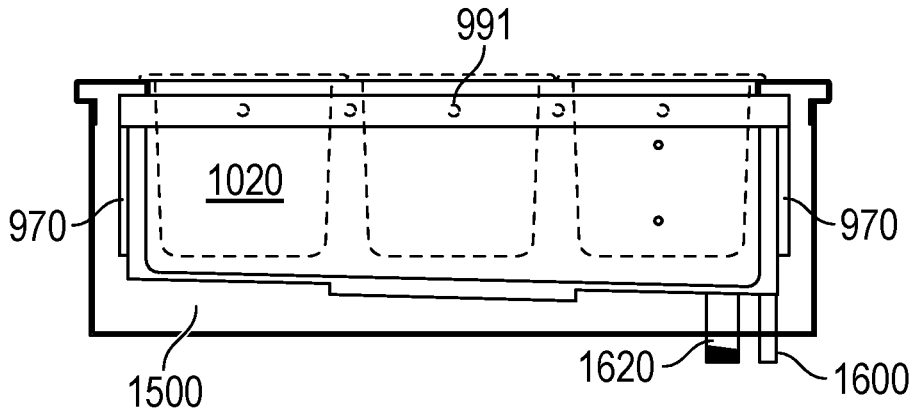
Figure 31:
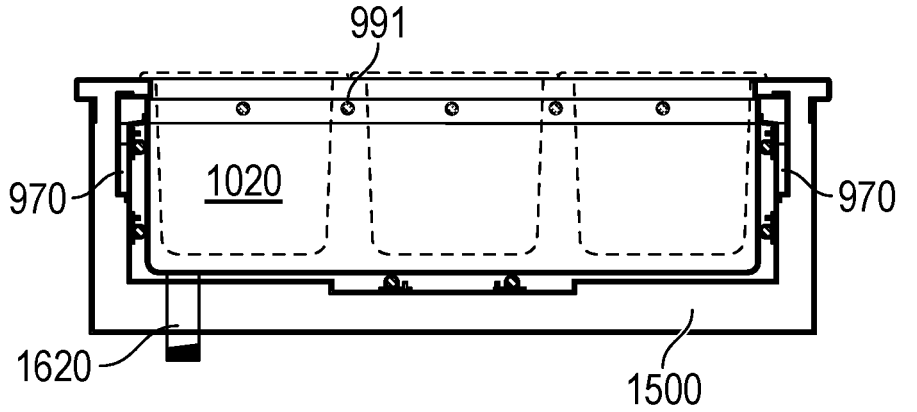
Figure 32:
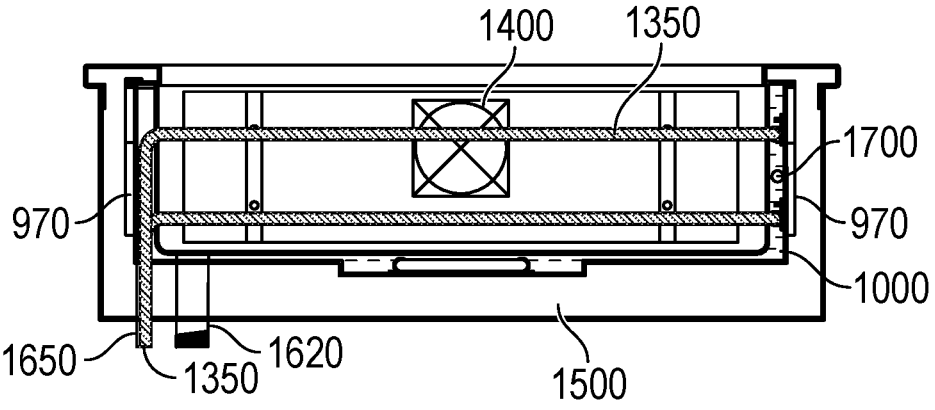
Figure 33:
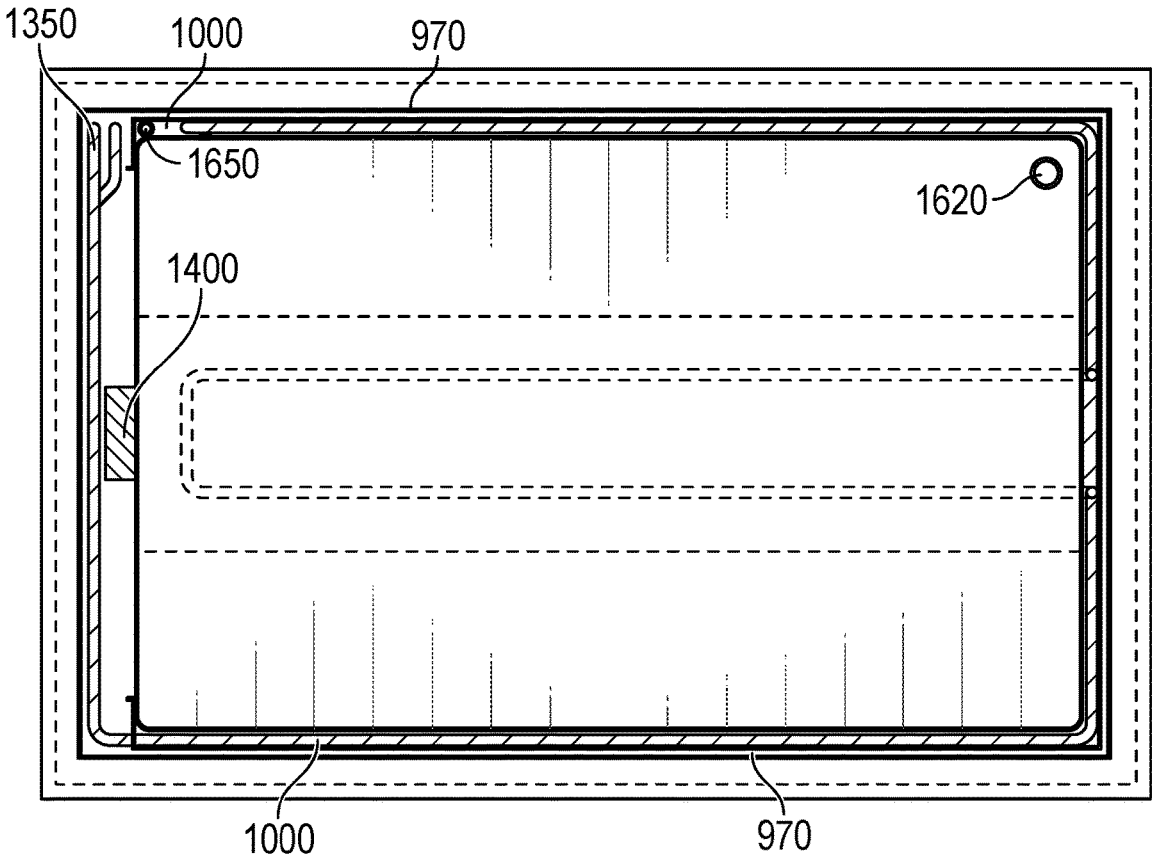
Figure 34:
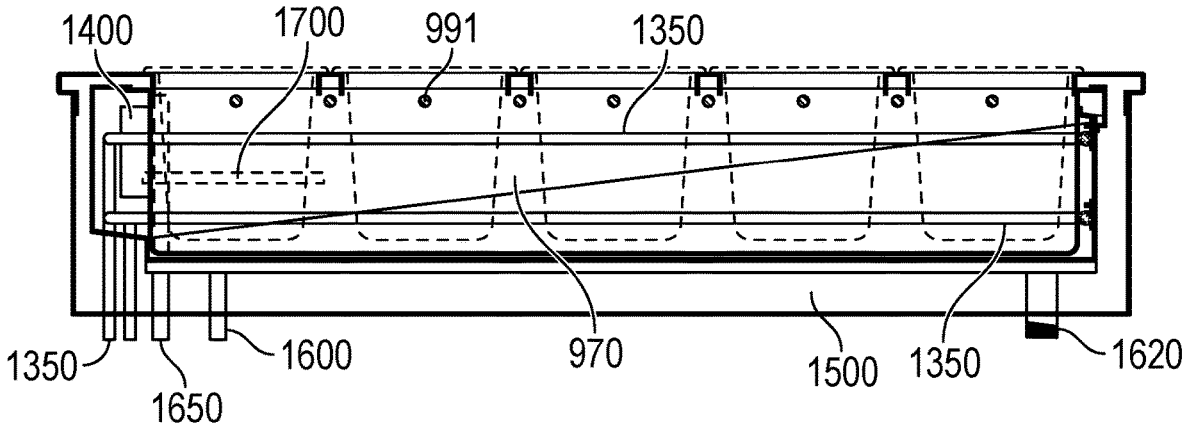

FIG. 29 depicts further details of the relationship between the air chamber 970 and coolant tank.

Figure 35:
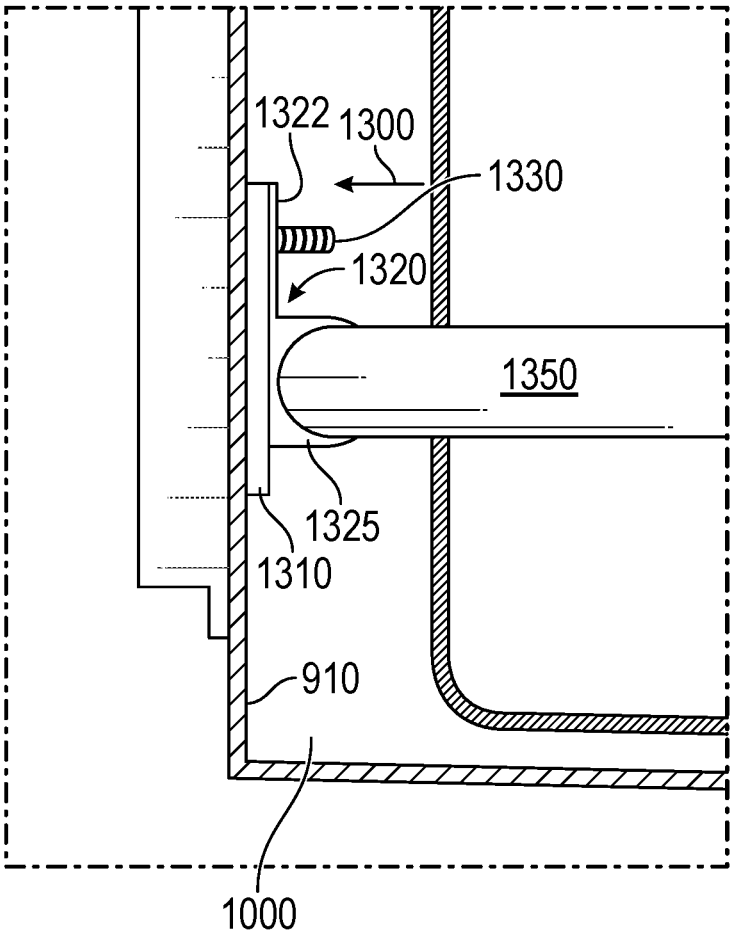

FIG. 35 depicts the components of the disclosed thermal retention assembly 1300 used to retain and keep a refrigeration line 1350 away from direct contact with a wall of the coolant tank 1000. In general, a thermal breaker strip 1310 may be attached to an outer shell 910 by use of a mounting stud 1330, the mounting stud welded or otherwise attached to the outer shell. A clamp assembly 1320 may also have a center void that is used for attachment to the mounting stud. To increase thermal insulation, the clamp assembly may comprise a flat section 1322 to provide distance between the mounting stud 1220 and the clamp fastener 1325. The clamp fastener keeps the refrigeration line away from the wall of the coolant tank.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A pan chiller system (900) comprising:

a) an outer shell (910);

b) the outer shell containing an outer tank liner (950);

c) the outer shell comprising four vertical walls and the outer tank liner comprising four vertical walls, with the four vertical walls of the outer tank liner and four vertical walls of the outer tank defining an outer air chamber (930);

d) the outer shell containing an inner tank liner (990) with the inner tank liner having four vertical walls;

e) the vertical walls of the outer shell and inner tank liner defining a coolant tank (1000);

f) the walls of the inner tank liner having outside surfaces defining an air chamber (970) the air chamber in fluid connection with a fan (1400);

g) the air chamber further defined by a plurality of lower angled boundaries (992)

h) the walls of the inner tank liner having inside surfaces defining a food well (1800);

i) the fan in fluid connection with the food well drawing air from the food well an into the air chamber, with the air passing through voids (991) defined within the inner tank liner;

j) the pan chiller system further including a plurality of clamp assemblies disposed within the coolant tank with the clamp assemblies securing a coolant line and the coolant tank containing a coolant such as glycerin with the glycerin cooled by the coolant line;

k) a temperature control well disposed within the coolant tank with the temperature control well in electronic connection with a cooling system cooling coolant within the coolant line;

l) wherein the coolant system comprises a multiple directional blow unit cooler comprising:

m) a front plate;

n) the front plate comprising a side wall with the side wall defining a plurality of voids;

o) the front plate further comprising a top ledge attached to and normal to the sidewall, with the top ledge defining a plurality of voids;

p) the front plate further comprising two sides, with each side comprising a lateral edge piece with each later lateral edge piece comprising a transition junction;

q) a backplate comprising a vertical wall with the vertical wall comprising a plurality of voids, the backplate further comprising a left side wall, a right side wall;

r) a drip pan;

s) a first and a second support structures attached to the back plate for further attachment with the wall or the ceiling, thereby allowing the front plate to be removed without having to dismount the multiple directional blow unit cooler from the wall or the ceiling, the first and the second support structures being any one of first and second back support angles and first and second mullion mount brackets; and t) an evaporation coil arranged laterally within a lower section of the back plate with air being drawn from a bottom of the evaporation coil, thereby allowing the voids of the back plate to be covered or filled with fans without disturbing the evaporation coil; and u) wherein the front plate is fastened to the back plate and the drip pan is attached below the front plate and back plate in a manner that defines a circulation void for drawing air over the evaporation coil, with the circulation void being defined by top edges of the pan and lower edges of the front plate and lower edges of the back plate.

* * * * *